US008554107B2

(12) United States Patent
Itabashi

(10) Patent No.: US 8,554,107 B2
(45) **Date of Patent: *Oct. 8, 2013**

(54) TONER BOX AND DEVELOPING DEVICE HAVING THE SAME

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 26 days.

This patent is subject to a terminal disclaimer.

(21) Appl. No.: 13/075,136

(22) Filed: Mar. 29, 2011

(65) Prior Publication Data

US 2011/0280612 A1 Nov. 17, 2011

(30) Foreign Application Priority Data

May 17, 2010 (JP) ..... 2010-113668

(51) Int. Cl.
*G03G 15/08* (2006.01)

(52) U.S. Cl.
USPC ..... 399/106; 399/260; 399/262

(58) Field of Classification Search
USPC ..... 399/106, 260, 262
See application file for complete search history.

(56) References Cited

U.S. PATENT DOCUMENTS

| | | | |
|---|---|---|---|
| 4,937,628 | A | 6/1990 | Cipolla et al. |
| 5,419,468 | A | 5/1995 | Taki |
| 5,608,501 | A | 3/1997 | Makino |
| 5,999,770 | A | 12/1999 | Li |
| 6,097,907 | A | 8/2000 | Fujiwara |
| 6,185,401 | B1 | 2/2001 | Kanamori et al. |
| 6,215,974 | B1 | 4/2001 | Katoh et al. |
| 6,324,370 | B1 | 11/2001 | Isobe et al. |
| 6,564,029 | B2 | 5/2003 | Kojima et al. |
| 7,062,195 | B2 | 6/2006 | Kurihara et al. |
| 8,358,953 | B2 | 1/2013 | Itabashi |
| 2002/0141777 | A1 | 10/2002 | Kamimura et al. |
| 2006/0067734 | A1 | 3/2006 | Igarashi et al. |
| 2006/0140652 | A1 | 6/2006 | Itabashi |
| 2006/0285885 | A1* | 12/2006 | Lee ..... 399/262 |
| 2009/0087215 | A1 | 4/2009 | Sakuma |

(Continued)

FOREIGN PATENT DOCUMENTS

| | | | |
|---|---|---|---|
| CN | 1828443 | A | 9/2006 |
| CN | 101403882 | A | 4/2009 |

(Continued)

OTHER PUBLICATIONS

Japan Patent Office, Decision to Grant for Japanese Patent Application No. 2010-113667 (counterpart to above-captioned patent application), mailed Feb. 7, 2012.

(Continued)

*Primary Examiner* — Ryan Walsh
(74) *Attorney, Agent, or Firm* — Baker Botts L.L.P.

(57) ABSTRACT

A toner box includes: a main body; a shutter; and a shutter cover. The main body is configured to accommodate toner therein and has a main-body-side communication through-hole, through which an interior and an exterior of the main body communicate. The shutter is disposed so as to be capable of moving between an open position in which the shutter opens the main-body-side communication through-hole, and a closed position in which the shutter closes the main-body-side communication through-hole. The shutter cover is configured to cover part of the shutter and that is elastically deformable.

22 Claims, 24 Drawing Sheets

(56) References Cited

U.S. PATENT DOCUMENTS

| | | | |
|---|---|---|---|
| 2009/0087216 | A1 | 4/2009 | Sakuma |
| 2009/0142079 | A1 | 6/2009 | Sato et al. |
| 2009/0169267 | A1 | 7/2009 | Sakuma |
| 2009/0190963 | A1 | 7/2009 | Nozawa |
| 2009/0245854 | A1 | 10/2009 | Sakuma |
| 2010/0021201 | A1 | 1/2010 | Tamaru |
| 2010/0054798 | A1 | 3/2010 | Sato |
| 2010/0054800 | A1 | 3/2010 | Okabe |
| 2010/0067947 | A1 | 3/2010 | Yuzawa |
| 2011/0280610 | A1 | 11/2011 | Itabashi |
| 2011/0280611 | A1 | 11/2011 | Itabashi |
| 2011/0280616 | A1 | 11/2011 | Itabashi |
| 2011/0280630 | A1 | 11/2011 | Itabashi |
| 2011/0299878 | A1 | 12/2011 | Kamimura |
| 2011/0299879 | A1 | 12/2011 | Kamimura |
| 2012/0003000 | A1 | 1/2012 | Nishiyama et al. |
| 2012/0033988 | A1 | 2/2012 | Itabashi |

FOREIGN PATENT DOCUMENTS

| | | | |
|---|---|---|---|
| JP | S64-029656 | U | 2/1989 |
| JP | H05-257340 | A | 10/1993 |
| JP | H05-289513 | A | 11/1993 |
| JP | H06-035322 | A | 2/1994 |
| JP | H07-168428 | A | 7/1995 |
| JP | H07-225514 | A | 8/1995 |
| JP | H08-022187 | A | 1/1996 |
| JP | H08-292635 | A | 11/1996 |
| JP | H09-230684 | A | 9/1997 |
| JP | H09-269639 | A | 10/1997 |
| JP | H09-269716 | A | 10/1997 |
| JP | H10-142912 | A | 5/1998 |
| JP | H11-084838 | A | 3/1999 |
| JP | H11-166409 | A | 6/1999 |
| JP | H11-212349 | A | 8/1999 |
| JP | 2000-029300 | A | 1/2000 |
| JP | 2000-187378 | A | 7/2000 |
| JP | 2001-083788 | A | 3/2001 |
| JP | 2001-083792 | A | 3/2001 |
| JP | 2001-125359 | A | 5/2001 |
| JP | 2001-194884 | A | 7/2001 |
| JP | 2002-055524 | A | 2/2002 |
| JP | 2003-107892 | A | 4/2003 |
| JP | 2006-098772 | A | 4/2006 |
| JP | 2006-171397 | A | 6/2006 |
| JP | 2006-227662 | A | 8/2006 |
| JP | 2007-121942 | A | 5/2007 |
| JP | 2008-191578 | A | 8/2008 |
| JP | 2009-058722 | A | 3/2009 |
| JP | 2009-086479 | A | 4/2009 |
| JP | 2009-139489 | A | 6/2009 |
| JP | 2009-157204 | A | 7/2009 |
| JP | 2009-169308 | A | 7/2009 |
| JP | 2009-175403 | A | 8/2009 |
| JP | 2009-237252 | A | 10/2009 |
| JP | 2010-032573 | A | 2/2010 |
| JP | 2010-054837 | A | 3/2010 |
| JP | 2010-072307 | A | 4/2010 |
| JP | 2010-079295 | A | 4/2010 |

OTHER PUBLICATIONS

Japan Patent Office, Decision to Grant for Japanese Patent Application No. 2010-113668 (counterpart to above-captioned patent application), mailed Feb. 7, 2012.

Japan Patent Office, Office Action for Japanese Patent Application No. 2010-113670 (counterpart to above-captioned patent application), mailed Feb. 7, 2012.

Japan Patent Office, Office Action for Japanese Patent Application No. 2010-113666 (counterpart to above-captioned patent application), mailed Apr. 3, 2012.

European Patent Office, extended European Search Report for European Patent Application No. 11160311.4 (counterpart to above-captioned patent application), dated Sep. 5, 2011.

European Patent Office, extended European Search Report for European Patent Application No. 11160154.8 (counterpart to above-captioned patent application), dated Sep. 7, 2011.

European Patent Office, partial European Search Report for European Patent Application No. 11160300.7 (counterpart European patent application), dated Jan. 22, 2013.

State Intellectual Property Office of the People's Republic of China, The First Office Action for Chinese Patent Application No. 201110090810.7 (counterpart Chinese patent application), mailed Jan. 11, 2013.

State Intellectual Property Office of the People's Republic of China, The First Office Action for Chinese Patent Application No. 201110090791.8 (counterpart Chinese patent application), mailed Jan. 11, 2013.

State Intellectual Property Office of the People's Republic of China, The First Office Action for Chinese Patent Application No. 201110090794.1 (counterpart Chinese patent application), mailed Jan. 11, 2013.

English Language Translation of Japanese Patent Application Publication No. 2000-187378 A, Jul. 4, 2000.

United States Patent and Trademark Office, Office Action for U.S. Appl. No. 13/074,191 (related US patent application), mailed Nov. 5, 2012.

United States Patent and Trademark Office, Non-Final Office Action for U.S. Appl. No. 13/073,906 (related U.S. patent application), mailed Dec. 21, 2012.

European Patent Office, extended European Search Report for European Patent Application No. 11160300.7 (counterpart European patent application), dated Apr. 19, 2013.

United States Patent and Trademark Office, Non-Final Office Action for U.S. Appl. No. 13/073,800 (related U.S. patent application) issued Apr. 4, 2013.

State Intellectual Property Office of the People'S Republic of China, Notification of Second Office Action for Chinese Patent Application No. 201110090791.8 (counterpart to above-captioned patent application), mailed Aug. 6, 2013.

* cited by examiner

TONER BOX AND DEVELOPING DEVICE HAVING THE SAME

CROSS REFERENCE TO RELATED APPLICATION

This application claims priority from Japanese Patent Application No. 2010-113668 filed May 17, 2010. The entire content of this priority application is incorporated herein by reference.

TECHNICAL FIELD

The present invention relates to a toner box and a developing device for an image-forming device.

BACKGROUND

Some conventional image-forming devices, such as laser printers, are provided with a photosensitive drum, a developing device, and a toner box mounted on the case of the developing device for accommodating toner.

The toner box has an arc-shaped peripheral surface, for example, with a toner outlet formed in the arc-shaped peripheral surface for discharging toner into the developing device. A sealing member is provided around the toner outlet to prevent toner from leaking from the toner box. A shutter is slidably disposed on the outside of the arc-shaped peripheral surface for opening and closing the toner outlet.

After the toner box is mounted on the case of the developing device, the toner outlet is opened by sliding the shutter to a position not opposing the toner outlet. Through this operation, toner in the toner box can be supplied to the developing device through the toner outlet.

In an image-forming operation, the conventional image-forming device having the structure described above forms an electrostatic latent image on the surface of the photosensitive drum. A developing unit of the developing device develops the latent image into a toner image. When the toner box begins to run out of toner as the toner is consumed in image-forming operations, an operator removes this toner box from the case of the developing device and mounts a new toner box in its place.

Before the operator removes the toner box from the case of the developing device, the operator slides the shutter to a position opposing the toner outlet so that the shutter closes the toner outlet. In this state, the shutter is in close contact with the sealing member, which seals the gap between the shutter and the periphery of the toner outlet. Thus, this construction prevents toner in the toner box from leaking out through the toner outlet after the toner box has been removed from the case of the developing device.

However, toner will possibly leak through the toner outlet from the toner box if the shutter is moved from the closed position to the open position after the toner box is removed from the case of the developing device and is taken out of the main body frame of the image forming device. Further, the shutter will possibly be bumped against an ambient component due to the operator's inadvertent handling of the boner box, thereby breaking down the shutter.

SUMMARY

In view of the foregoing, it is an object of the present invention to provide an improved toner box and an improved developing device equipped with the toner box.

In order to attain the above and other objects, the present invention provides a toner box including: a main body; a shutter; and a shutter cover. The main body is configured to accommodate toner therein and has a main-body-side communication through-hole, through which an interior and an exterior of the main body communicate. The shutter is disposed so as to be capable of moving between an open position in which the shutter opens the main-body-side communication through-hole, and a closed position in which the shutter closes the main-body-side communication through-hole. The shutter cover is configured to cover part of the shutter and that is elastically deformable.

According to another aspect, the present invention provides a developing device including: a developing unit; and the above-described toner box. The developing unit is configured so as to be capable of being disposed in a device body of an image-forming device. The toner box is detachably mounted in the developing unit. The developing unit is provided with a shutter drive member that is configured to move the shutter of the toner box between the open position and the closed position.

DETAILED DESCRIPTION

Next, an embodiment of the present invention will be described while referring to the accompanying drawings.

1. Structure of a Color Printer

Figure 1:
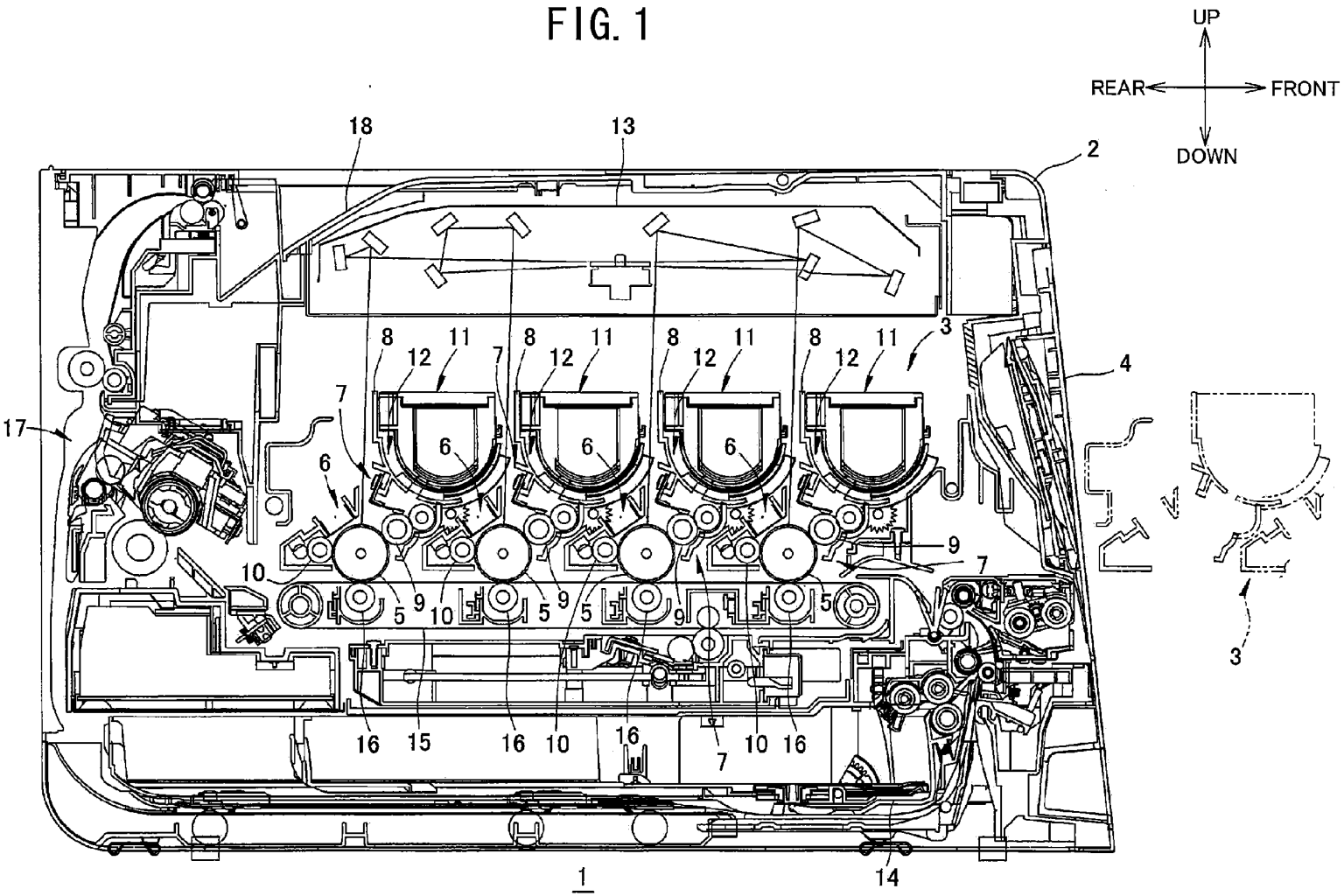
FIG. 1 is a cross-sectional view of a color printer according to an embodiment of the present invention.
Figure 2:
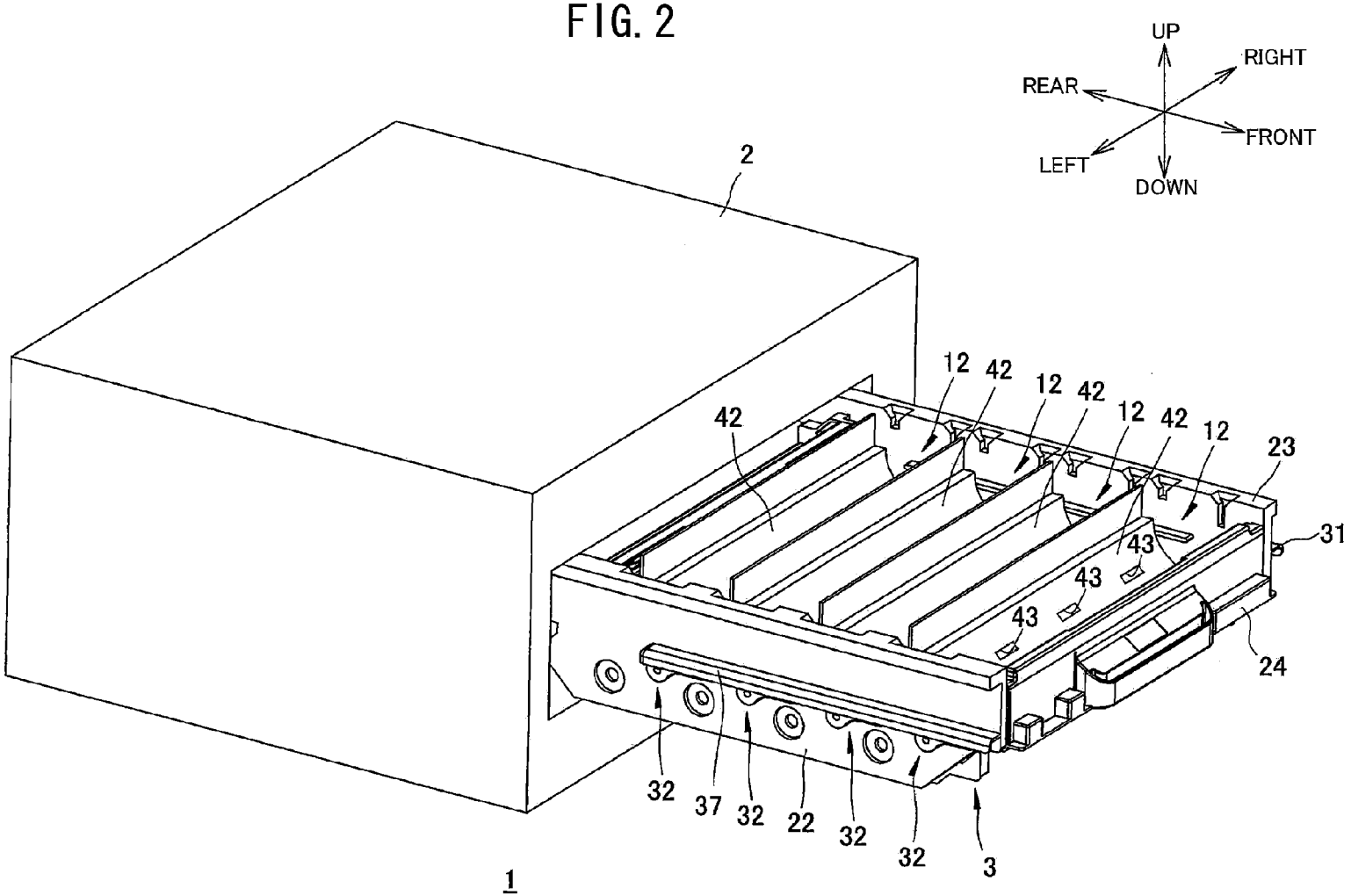
FIG. 2 is a perspective view of the color printer in FIG. 1 showing a drawer unit that has been pulled outward from a main frame of the printer.

As shown in FIG. 1, the image-forming device according to the embodiment is a tandem-type color printer 1. As shown in FIGS. 1 and 2, the color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2, as indicated by solid lines in FIG. 1, and a withdrawn position outside the main casing 2, as depicted virtually by dotted lines in FIG. 1 and shown in FIG. 2.

In the following description, the side of the color printer 1 on which the front cover 4 is provided (right side in FIG. 1) will be referred to as the front side of the color printer 1. The top, bottom, left, and right sides of the color printer 1 in the following description will be based on the reference point of a user viewing the color printer 1 from the front side. Directions related to the drawer unit 3 and toner boxes 11, described later, that are mounted in the drawer unit 3 will be referenced based on their positions when mounted in the main casing 2, unless otherwise specified. Note that the front cover 4 has been omitted from FIG. 2.

As shown in FIG. 1, four photosensitive drums 5 are rotatably retained in the drawer unit 3. The photosensitive drums 5 are capable of rotating about axes extending in the left-to-right direction. The four photosensitive drums 5 are respectively provided for the colors black, yellow, magenta, and cyan. The photosensitive drums 5 are arranged parallel to each other at regular intervals in the front-to-rear direction in the order black, yellow, magenta, and cyan.

Four chargers 6 are also retained in the drawer unit 3. The chargers 6 have a one-on-one correspondence to the four photosensitive drums 5 and are disposed at positions diagonally upward and rearward from the corresponding photosensitive drums 5. Each charger 6 is a Scorotron charger that includes a discharge wire and grid, for example.

Four developing units 7 are also retained in the drawer unit 3. The four developing units 7 also have a one-on-one correspondence to the four photosensitive drums 5 and are disposed diagonally above and forward of the corresponding photosensitive drums 5. Each developing unit 7 includes a developing unit frame 8, and a developing roller 9 accommodated in the developing unit frame 8. The developing roller 9 is disposed in contact with the photosensitive drum 5 and is capable of rotating about an axis extending in the left-to-right direction.

Four cleaners 10 are also retained in the drawer unit 3. The cleaners 10 are provided with a one-on-one correspondence to the four photosensitive drums 5 and are positioned rearward of the corresponding photosensitive drums 5. The cleaners 10 function to move paper dust and the like deposited on the surfaces of the photosensitive drums 5.

A space 12 is provided in the drawer unit 3 above each developing unit 7. A toner box 11 that accommodates toner is mounted in the space 12 formed above each developing unit 7. Sufficient room above the drawer unit 3 for mounting the toner boxes 11 in the spaces 12 is acquired by pulling the drawer unit 3 outward to the withdrawn position. The toner boxes 11 supply toner to the corresponding developing units 7.

An exposure device 13 is provided in the main casing 2 above the drawer unit 3. The exposure device 13 irradiates four laser beams corresponding to the four colors used by the color printer 1.

As each photosensitive drum 5 rotates, the corresponding charger 6 applies a uniform charge to the surface of the photosensitive drum 5 through corona discharge. Subsequently, the exposure device 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of a photosensitive drum 5 rotates to a position opposite the corresponding developing roller 9, the developing roller 9 supplies toner to the latent image, developing the image into a toner image. That is, the developing roller 9 executes a developing operation.

Here, four LED arrays may be provided for the four photosensitive drums 5 in place of the exposure device 13.

A paper cassette 14 accommodating sheets of a paper P is disposed in a bottom section of the main casing 2. The paper P accommodated in the paper cassette 14 is conveyed onto a conveying belt 15 by various rollers. The conveying belt 15 confronts the four photosensitive drums 5 from below. Four transfer rollers 16 are disposed inside the conveying belt 15 at positions confronting each of the photosensitive drums 5 through the upper portion of the conveying belt 15. When a sheet of paper P is conveyed onto the conveying belt 15, the conveying belt 15 carries the sheet sequentially through positions between the conveying belt 15 and each of the photosensitive drums 5. As the sheet passes beneath each photosensitive drum 5, the toner image carried on the surface of the photosensitive drum 5 is transferred onto the paper P.

A fixing unit 17 is provided on the downstream end of the conveying belt 15 with respect to the direction that the paper P is conveyed. After toner images are transferred onto a sheet of paper P, the sheet is conveyed to the fixing unit 17, where the toner images are fixed to the sheet by heat and pressure. After the toner images are fixed in the fixing unit 17, various rollers discharge the sheet onto a discharge tray 18 formed on the top surface of the main casing 2.

2. Drawer Unit (1) Drawer Frame

Figure 3:
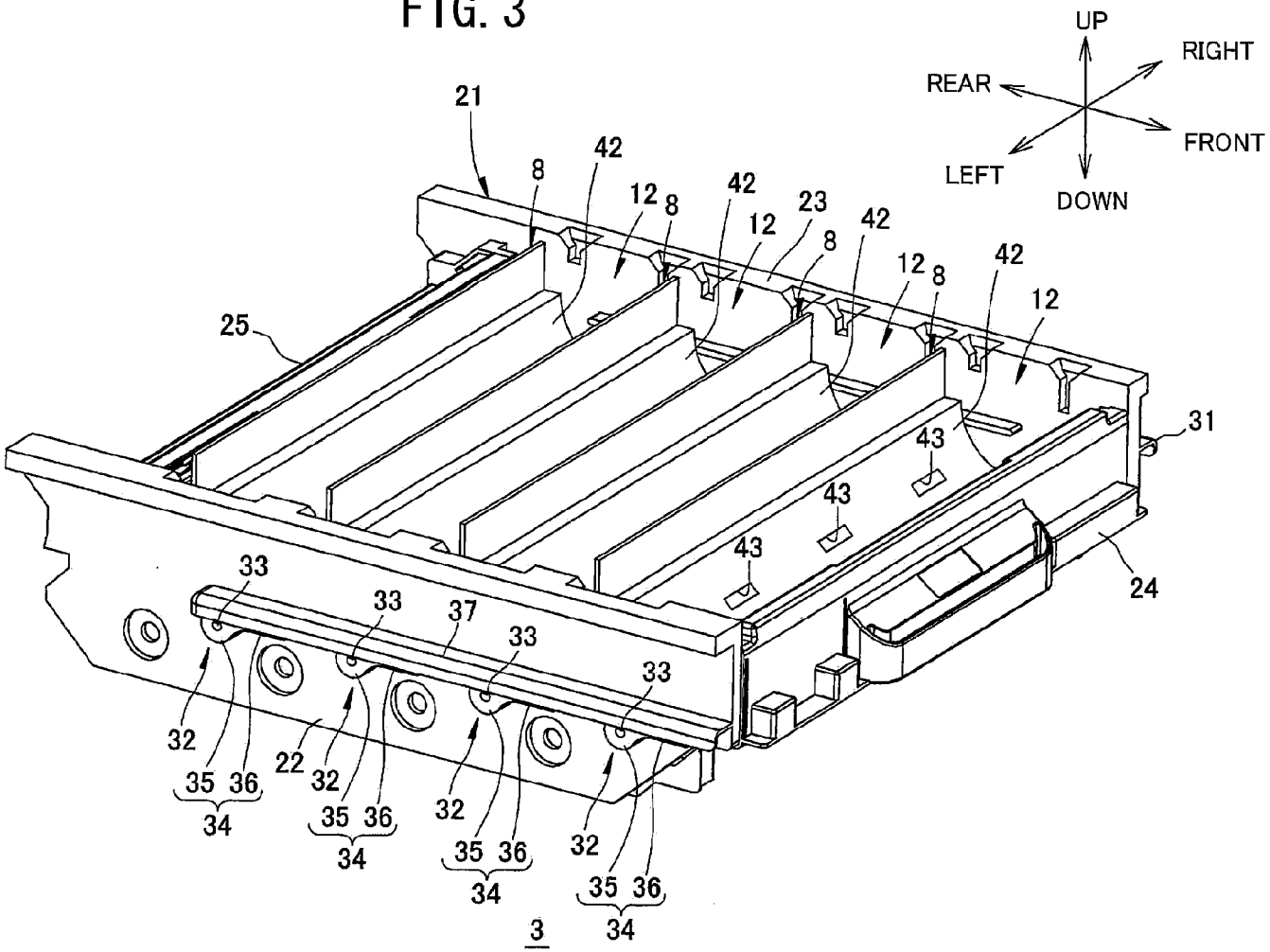
FIG. 3 is a perspective view of the drawer unit in FIG. 2 when toner boxes have all been removed.

As shown in FIG. 3, the drawer unit 3 has a drawer frame 21. The drawer frame 21 is configured of a pair of side plates 22 and 23 arranged parallel to each other and separated in the left-to-right direction, a front beam 24 bridging the front ends of the side plates 22 and 23, and a rear beam 25 bridging the rear ends of the side plates 22 and 23. The overall structure of the drawer frame 21 is square-shaped in a plan view.

The respective groups of four photosensitive drums 5, chargers 6, developing units 7, and cleaners 10 (see FIG. 1) are all held together between the side plates 22 and 23 on the left and right sides thereof. The spaces 12 in which the toner boxes 11 are mounted are formed between the side plates 22 and 23 above the corresponding developing units 7. In other words, the side plates 22 and 23 hold the photosensitive drums 5, chargers 6, developing units 7, and cleaners 10. Further, the side plates 22 and 23 oppose each other in the left-to-right direction, with gaps formed therebetween to allocate the spaces 12 in which the toner boxes 11 are mounted.

(2) Opening Members

Figure 4A:
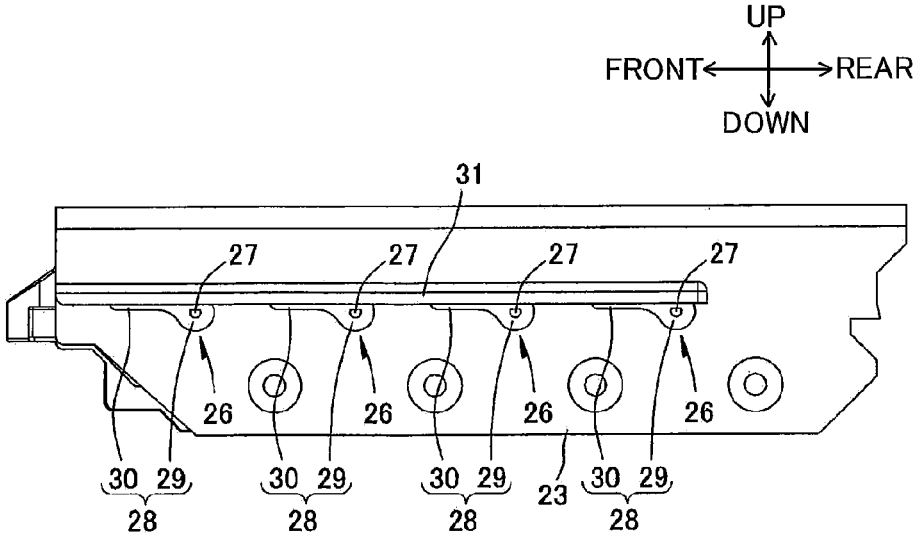
FIG. 4A is a right side view of the drawer unit in FIG. 2 when opening members are in a second position and shutters are in an open position.
Figure 5A:
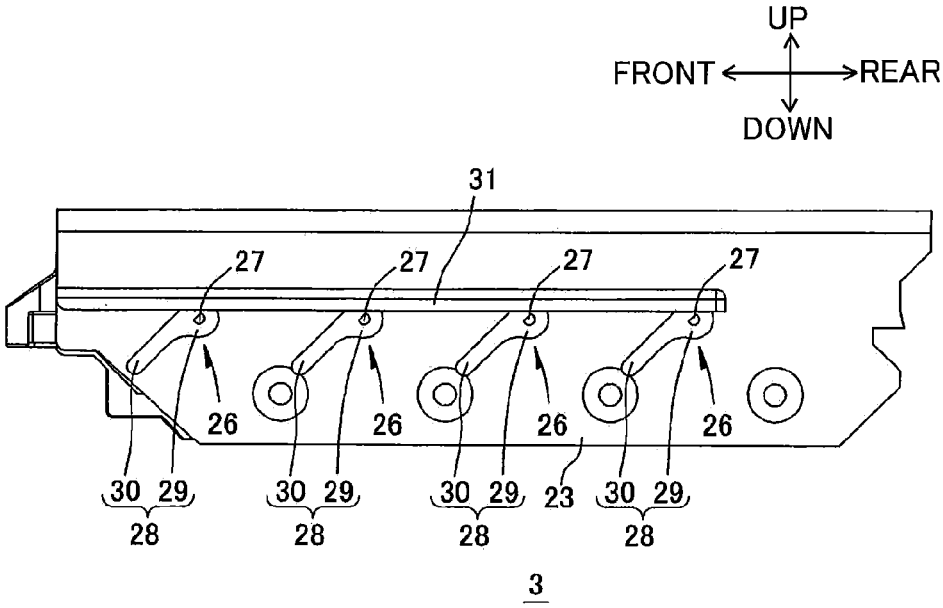
FIG. 5A is a right side view of the drawer unit when the opening members are in a first position and the shutters are in a closed position.

As shown in FIGS. 4A and 5A, four opening members 26 are disposed on the right side surface (outer surface) of the right side plate 23 at positions corresponding to the spaces 12. Each opening member 26 includes a rotating support part 27 configured of a shaft extending in the left-to-right direction, and a lever part 28 coupled to the rotating support part 27.

The rotating support part 27 is rotatably supported in the side plate 23.

The lever part 28 is integrally configured of a coupling part 29 having a circular shape in a side view, and an arm part 30 that has a narrow elongated plate shape extending forward from the coupling part 29, for example. The lever part 28 is coupled to the rotating support part 27 by inserting the rotating support part 27 into the coupling part 29 so that the rotating support part 27 cannot rotate relative to the coupling part 29.

By pivoting the opening member 26 with the rotating support part 27 serving as the fulcrum, the opening member 26 can be shifted between a first position in which the arm part 30 of the lever part 28 slopes diagonally forward and downward, as shown in FIG. 5A, and a second position in which the arm part 30 extends horizontally, as shown in FIG. 4A. Hence, the direction in which the opening member 26 moves from the first position to the second position (i.e., the rotating direction) is clockwise when viewing the opening member 26 from the right side.

A first cover 31 is disposed above the opening members 26 on the right side surface of the right side plate 23 for covering all four opening members 26 in the second position. In a cross-sectional view, the first cover 31 is L-shaped, extending rightward, then bending and extending downward. As shown in FIG. 4A, most of the upper half of the coupling part 29 and most of the entire arm part 30 constituting the lever part 28 are accommodated inside the first cover 31 (between the first cover 31 and the side plate 23) when the opening member 26 is in the second position. The first cover 31 is integrally formed with the side plate 23.

(3) Closing Members

Figure 4B:
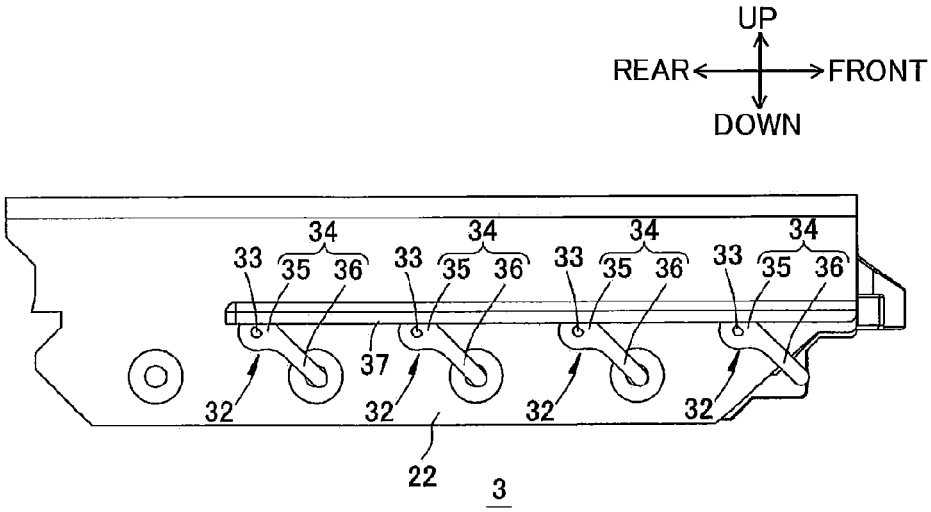
FIG. 4B is a left side view of the drawer unit when a closing members are in a third position and the shutters are in the open position.
Figure 5B:
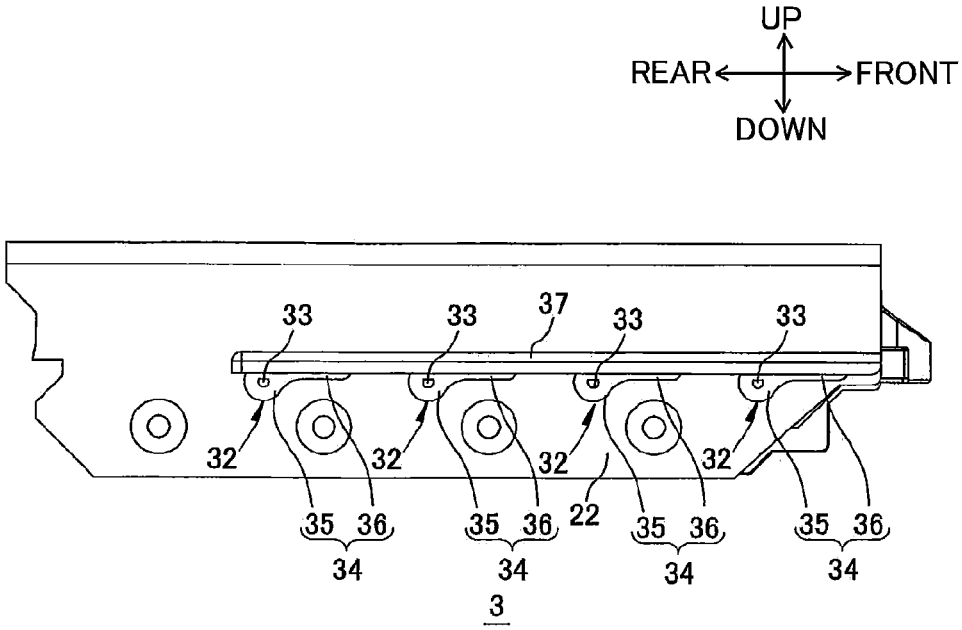
FIG. 5B is a left side view of the drawer unit when the closing members are in a fourth position and the shutters are in the closed position.

As shown in FIGS. 4B and 5B, four closing members 32 are disposed on the left side surface (outer surface) of the left side plate 22 at positions corresponding to the spaces 12. Each closing member 32 includes a rotating support part 33 configured of a shaft extending in the left-to-right direction, and a lever part 34 coupled to the rotating support part 33.

The rotating support part 33 is rotatably supported in the side plate 22.

The lever part 34 is integrally configured of a coupling part 35 having a circular shape in a side view, and an arm part 36 that has a narrow elongated plate shape extending forward from the coupling part 35, for example. The lever part 34 is coupled to the rotating support part 33 by inserting the rotating support part 33 into the coupling part 35 so that the rotating support part 33 cannot rotate relative to the coupling part 35.

By pivoting the closing member 32 with the rotating support part 33 serving as the fulcrum, the closing member 32 can be shifted between a third position in which the arm part 36 of the lever part 34 slopes diagonally forward and downward, as shown in FIG. 4B, and a fourth position in which the arm part 36 extends horizontally, as shown in FIG. 5B. Hence, the direction in which the closing member 32 moves from the third position to the fourth position (i.e., the rotating direction) is opposite the direction in which the opening member 26 moves from the first position to the second position, i.e., counterclockwise when viewing the closing member 32 from the left side.

A second cover 37 is disposed above the closing members 32 on the left side surface of the left side plate 22 for covering all four closing members 32 in the fourth position. In a cross-sectional view, the second cover 37 is L-shaped, extending leftward, then bending and extending downward. As shown in FIG. 5B, most of the upper half of the coupling part 35 and most of the entire arm part 36 constituting the lever part 34 are accommodated inside the second cover 37 (between the second cover 37 and the side plate 22) when the closing member 32 is in the fourth position. The second cover 37 is integrally formed with the side plate 22.

(4) Lever Interlocking Mechanism

Figure 6:
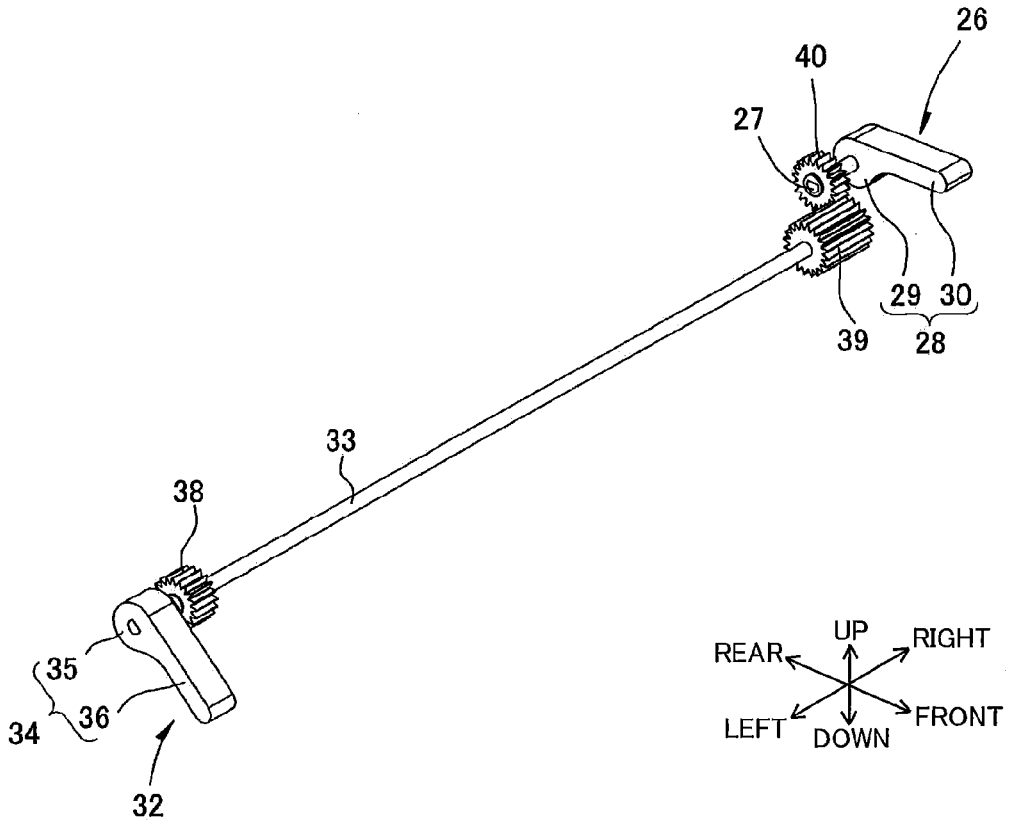
FIG. 6 is a perspective view of a mechanism for interlocking the opening member shown in FIG. 4A with the closing member shown in FIG. 4B.
Figure 7:
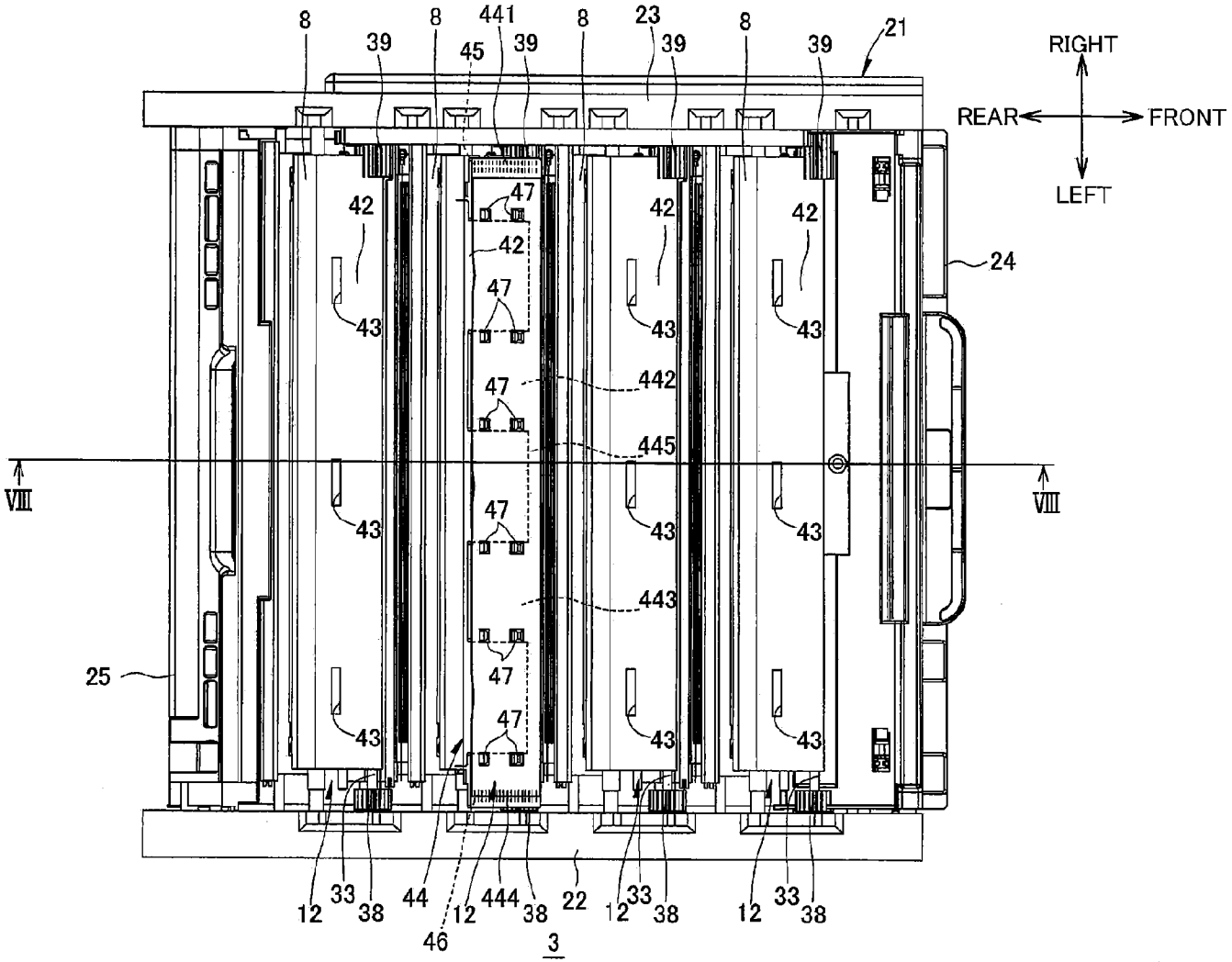
FIG. 7 is a plan view of the drawer unit in FIG. 3.

As shown in FIG. 6, the rotating support part 33 of the closing member 32 penetrates the left side plate 22 (see FIG. 3) and extends between the side plates 22 and 23 in the left-to-right direction. As shown in FIG. 7, a left pinion gear 38 is mounted on the left end of the rotating support part 33 to the right (inside) of the side plate 22 and is not capable of rotating relative to the rotating support part 33. A small gap is formed between the left pinion gear 38 and side plate 22 so that rotation of the left pinion gear 38 is not hindered. Similarly, a right pinion gear 39 is mounted on the right end of the rotating support part 33 to the left (inside) of the side plate 23 and is not capable of rotating relative to the rotating support part 33. The right pinion gear 39 is longer than the left pinion gear 38 in the left-to-right direction. A small gap is formed between the right pinion gear 39 and side plate 23 so that rotation of the right pinion gear 39 is not hindered.

The rotating support part 27 of each opening member 26 penetrates the right side plate 23 (see FIG. 3). As shown in FIG. 6, the left end of the rotating support part 27 opposes the right pinion gear 39 from the upper rear side. A pinion gear 40 is mounted on the left end of the rotating support part 27 and is incapable of rotating relative to the rotating support part 27. The pinion gear 40 is engaged with the right pinion gear 39.

As shown in FIGS. 4A, 4B, and 6, the positions of the opening members 26 and closing members 32 mounted on the drawer frame 21 are adjusted so that the closing members 32 are in their third positions when the opening members 26 are in their second positions.

When a closing member 32 is moved from the third position to the fourth position, the corresponding rotating support part 33, left pinion gear 38, and right pinion gear 39 rotate counterclockwise when viewed from the left. The rotation of the right pinion gear 39 is transferred to the pinion gear 40, rotating the pinion gear 40 and the rotating support part 27 clockwise in a left side view. Through the rotation of the rotating support part 27, the opening member 26 is moved from the second position to the first position.

Similarly, when an opening member 26 is moved from the first position to the second position, the rotating support part 27 and pinion gear 40 rotate counterclockwise in a left side view. The rotation of the pinion gear 40 is transferred to the right pinion gear 39, rotating the right pinion gear 39, rotating support part 33, and left pinion gear 38 clockwise in a left side view. The rotation of the rotating support part 33 moves the closing member 32 from the fourth position to the third position.

Accordingly, the opening member 26 moves from the second position to the first position in association with movement of the closing member 32 from the third position to the fourth position. Similarly, the closing member 32 moves from the fourth position to the third position in association with movement of the opening member 26 from the first position to the second position.

(5) Developing Unit Frame

As shown in FIGS. 3 and 7, the developing unit frames 8 are disposed at regular intervals in the front-to-rear direction and span between the side plates 22 and 23. The developing unit frames 8 define the spaces 12 provided for mounting the toner boxes 11.

Figure 8:
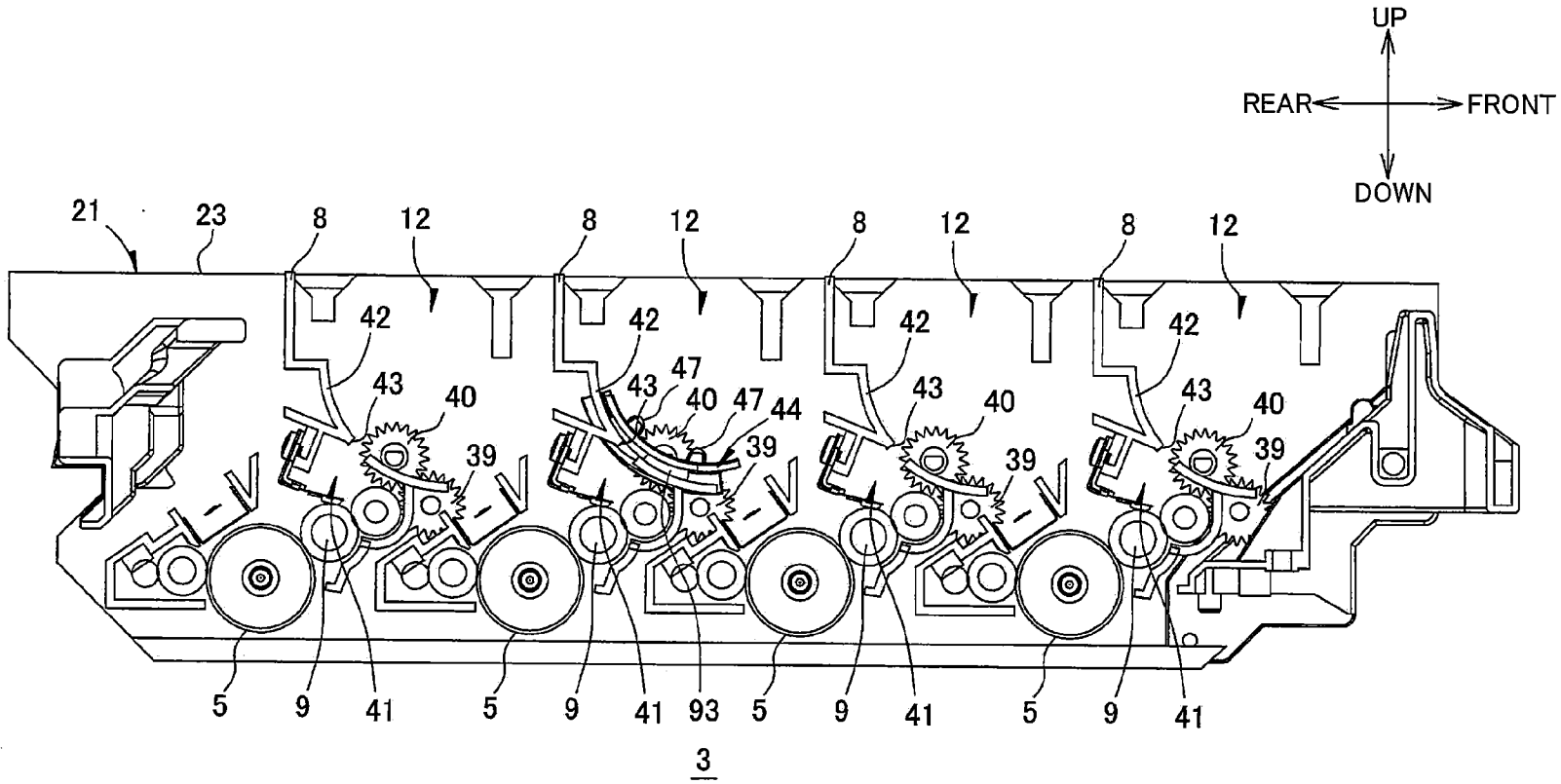
FIG. 8 is a cross-sectional view of the drawer unit taken along the cross-sectional line VIII-VIII shown in FIG. 7.

As shown in FIG. 8, a developing chamber 41 is formed in each developing unit frame 8 for accommodating the developing roller 9. The side of the developing chamber 41 opposing the corresponding photosensitive drum 5 is open. The developing roller 9 is disposed in the bottom of the developing chamber 41 near the open side thereof.

The developing unit frame 8 also has a plate-shaped partitioning wall 42 positioned between the developing chamber 41 and the space 12. The partitioning wall 42 curves in an arc shape with its convex side facing the developing chamber 41. The partitioning wall 42 partitions the interior of the developing unit frame 8 into the developing chamber 41 and the space 12 formed above the developing chamber 41. As shown in FIG. 3, three rectangular openings 43 are formed in the circumferential center of the partitioning wall 42. The rectangular openings 43 are formed at positions opposing three main-body-side communication through-holes 58 (described later with reference to FIG. 12) formed in the toner box 11 when the toner box 11 is mounted in the space 12.

(6) Shutter Drive Member

As shown in FIGS. 7 and 8, a shutter drive member 44 is movably disposed above the partitioning wall 42 for driving a shutter 73 described later.

Figure 9:
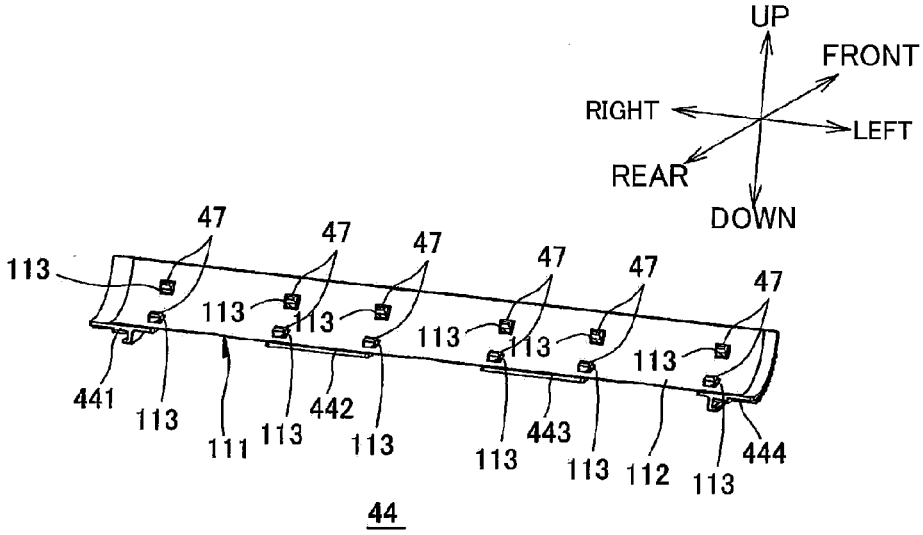
FIG. 9 is a perspective view of a shutter drive member shown in FIG. 8.

As shown in FIG. 9, the shutter drive member 44 includes a main body part 111 (resin plate) formed of a resin, and a reinforcing plate 112 (metal plate) formed of a thin metal plate that is affixed to the main body part 111.

Figure 10:
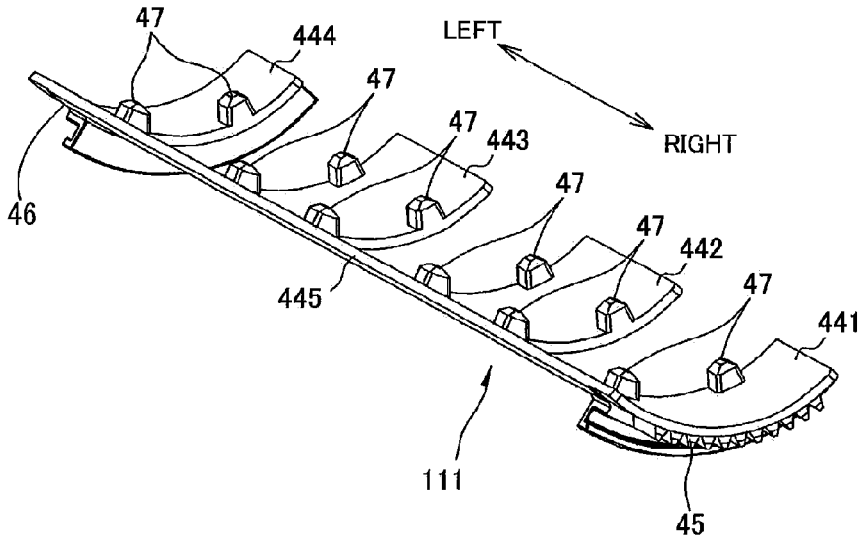
FIG. 10 is a perspective view of a main body part of the shutter drive member shown in FIG. 9.

As shown in FIG. 10, the main body part 111 is integrally configured of four plate-shaped parts 441, 442, 443, and 444 arranged at intervals in the left-to-right direction; and a coupling part 445 having a bar shape that extends in the left-to-right direction for coupling the front edges of the plate-shaped parts 441-444. Each of the plate-shaped parts 441-444 is formed of a plate curved in an arc, with the convex side facing the developing chamber 41. The curved arc of the plate-shaped part substantially conforms to the shape of the partitioning wall 42.

The shutter drive member 44 is provided above the partitioning wall 42 of each developing unit frame 8. For simplification, only the shutter drive member 44 disposed above one partitioning wall 42 is shown in FIGS. 7 and 8.

As shown in FIG. 7, the plate-shaped part 444 on the left end confronts the top of the left pinion gear 38. A left rack gear 46 is formed on the bottom surface of the plate-shaped part 444 (the surface opposing the left pinion gear 38) for engaging with the left pinion gear 38.

As shown in FIG. 7, the plate-shaped part 441 on the right end confronts the top of the right pinion gear 39. More specifically, the pinion gear 40 is engaged in the right end portion of the right pinion gear 39, and the right pinion gear 39 extends farther leftward than the pinion gear 40, as shown in FIG. 6. The plate-shaped part 441 opposes from above the portion of the right pinion gear 39 extending leftward from the pinion gear 40. A right rack gear 45 is formed on the bottom surface of the plate-shaped part 441 opposing the right pinion gear 39 and is engaged with the right pinion gear 39.

When a user operates one of the opening members 26 or closing members 32 to rotate the respective left pinion gear 38 or right pinion gear 39, the rotations of the left pinion gear 38 and right pinion gear 39 are transferred to the left rack gear 46 and right rack gear 45. As a result, the shutter drive member 44 moves between a position opposing the rectangular openings 43 (the position shown in FIG. 7) and a position forward of the rectangular openings 43. More specifically, when one of the opening members 26 is moved from the first position to the second position, the corresponding shutter drive member 44 moves forward from the position opposing the rectangular openings 43 along with the rotations of the left pinion gear 38 and right pinion gear 39 and is placed in a position not opposing the rectangular openings 43.

From this state, if the closing member 32 is moved from the third position to the fourth position, the shutter drive member 44 moves rearward along with the rotations of the left pinion gear 38 and right pinion gear 39 from the position not opposing the rectangular openings 43 to the position opposing the rectangular openings 43.

Shutter drive protrusions 47 are formed on the top surfaces of the plate-shaped parts 441-444 at positions corresponding to shutter drive openings 88 described later.

The reinforcing plate 112 covers the entire region of the main body part 111, excluding the right edge of the plate-shaped part 441 and the left edge of the plate-shaped part 444.

Insertion through-holes 113 are formed in the reinforcing plate 112 at positions overlapping the shutter drive protrusions 47. Each of the shutter drive protrusions 47 is inserted through a corresponding insertion through-hole 113 and protrudes upward from the reinforcing plate 112.

By overlaying the reinforcing plate 112 on the main body part 111 in this way, it is possible to ensure sufficient rigidity of the shutter drive member 44 so that the shutter drive member 44 can move the shutter 73 described later with reference to FIG. 12 with sufficient stability.

Further, by inserting the shutter drive protrusions 47 through the insertion through-holes 113 in the reinforcing plate 112, the position of the reinforcing plate 112 relative to the main body part 111 remains fixed with the shutter drive protrusions 47 protruding from the reinforcing plate 112.

Since the three rectangular openings 43 formed in the partitioning wall 42 are opened and closed by the reinforcing plate 112 moving in association with the shutter drive member 44, the reinforcing plate 112 functions as a developing-device-side shutter for opening and closing the rectangular openings 43.

3. Toner Box (1) Main Body

Figure 11:
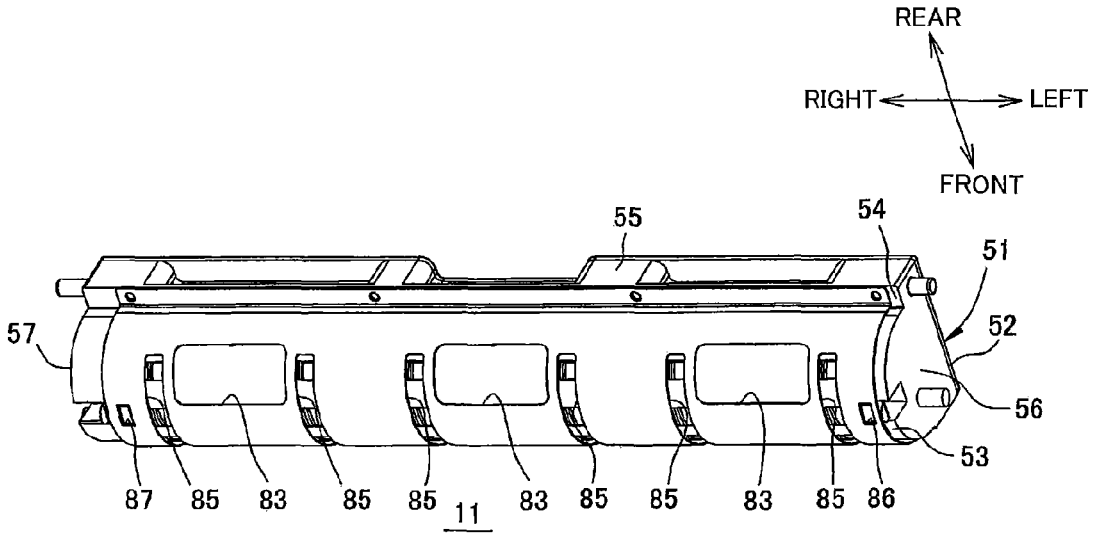
FIG. 11 is a perspective view of one of the toner boxes shown in FIG. 1.
Figure 12:
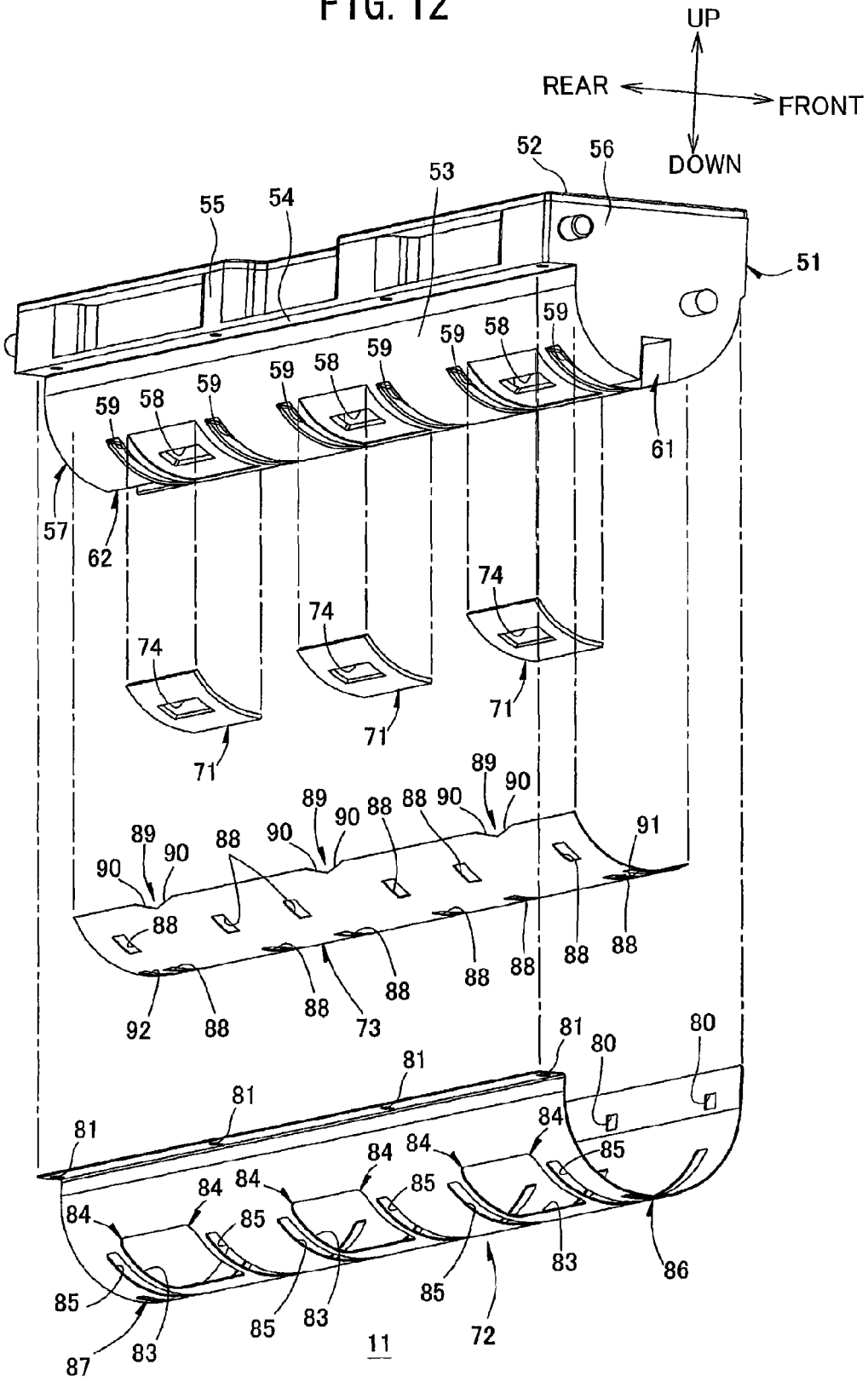
FIG. 12 is an exploded perspective view of the toner box in FIG. 11.

As shown in FIGS. 11 and 12, the toner box 11 includes a main body 51 for accommodating toner. The main body 51 is formed of a resin material in a substantially hollowed-out semicircular column shape and is elongated in the left-to-right direction. More specifically, the main body 51 has an internal space for accommodating toner that is formed by: a rectangular top surface 52 elongated in the left-to-right direction; an arcing surface 53 that is connected to the front edge of the top surface 52 and that has a substantially semicircular arc shape in a cross section with the convex side facing downward; a fixing surface 54 extending parallel to the top surface 52 and protruding rearward from the rear edge of the arcing surface 53; a rear surface 55 bridging the rear edge of the top surface 52 and the rear edge of the fixing surface 54; a left side surface 56 bridging the respective left edges of the top surface 52, arcing surface 53, fixing surface 54 and rear surface 55; and a right side surface 57 bridging the respective right edges of the top surface 52, arcing surface 53, fixing surface 54, and rear surface 55.

As shown in FIG. 12, three main-body-side communication through-holes 58 are formed in the arcing surface 53 of the main body 51 at positions slightly rearward of the lowest end thereof The main-body-side communication through-holes 58 are rectangular in shape and elongated in the left-to-right direction and are spaced at intervals in the left-to-right direction. The main-body-side communication through-holes 58 provide communication between the interior and exterior of the main body 51.

Narrow slit-shaped relief grooves (escape grooves) 59 are also formed in the arcing surface 53. The relief grooves 59 extend in the peripheral direction of the arcing surface 53 and are formed one on each of the left and right sides of each main-body-side communication through-hole 58.

Figure 16A:
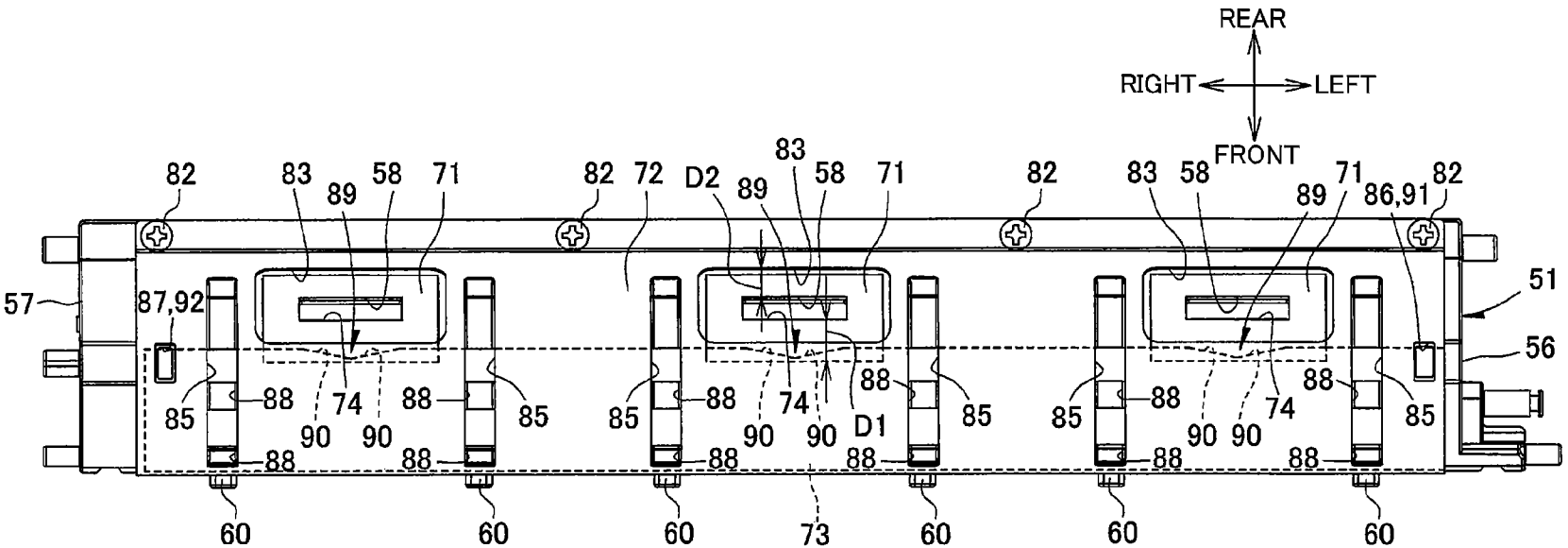
FIG. 16A is a bottom view of the toner box in FIG. 11 when the shutter is in the open position.
Figure 16B:
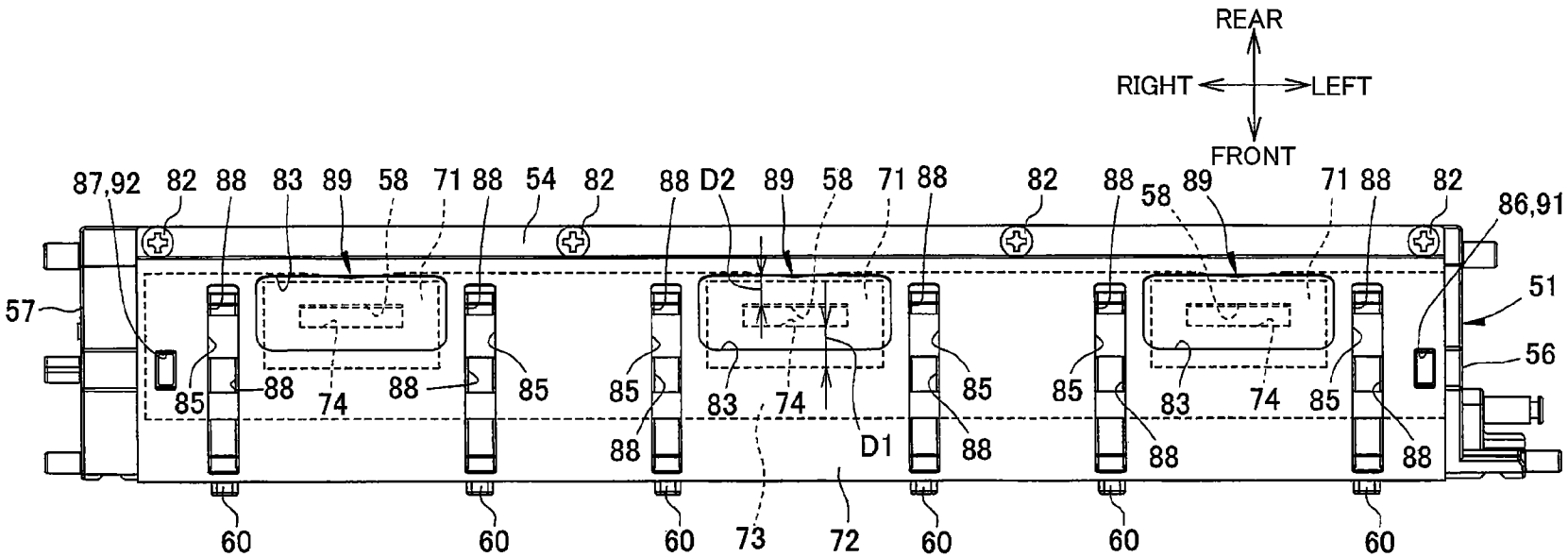
FIG. 16B is a bottom view of the toner box when the shutter is in the closed position.
Figure 17A:
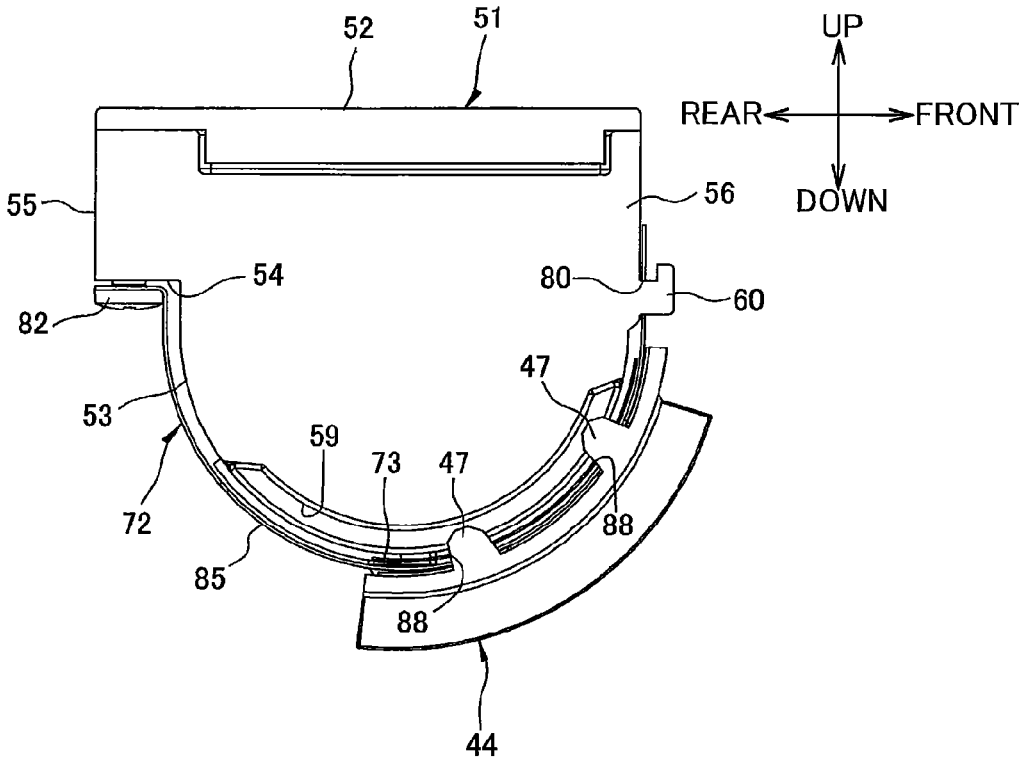
FIG. 17A is a cross-sectional view of the toner box in FIG. 11 and the shutter drive member in FIG. 7 when the shutter is in the open position.
Figure 17B:
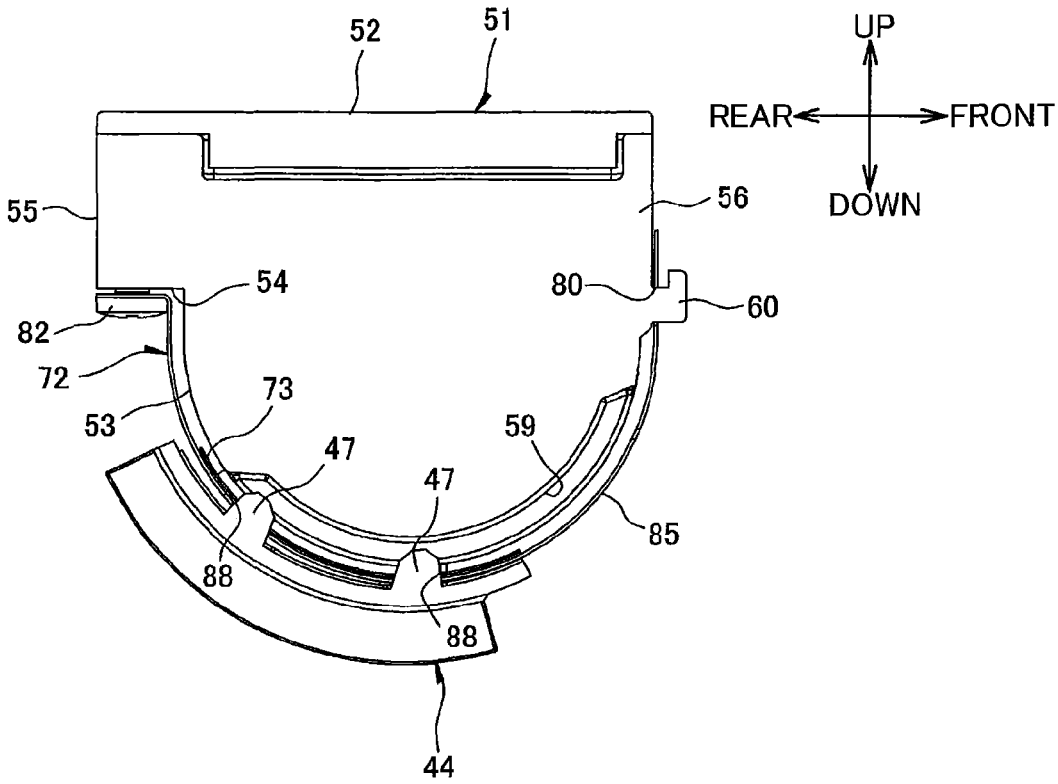
FIG. 17B is a cross-sectional view of the toner box in FIG. 11 and the shutter drive member in FIG. 7 when the shutter is in the closed position.

As shown in FIGS. 16A and 16B, a plurality of positioning protrusions 60 is formed on the front edge of the arcing surface 53. The positioning protrusions 60 are spaced at intervals in the left-to-right direction. As shown in FIGS. 17A and 17B, each positioning protrusion 60 has a hook shape, extending forward, then bending and extending upward.

As shown in FIG. 12, recessions 61 and 62 are respectively formed in the left and right ends of the main body 51 in the lowest portion of the arcing surface 53. The recession 61 on the left side is open in the left side surface 56 of the main body 51, while the recession 62 on the right side is open in the right side surface 57 of the main body 51.

The toner box 11 further includes toner seals 71 affixed to the arcing surface 53 of the main body 51, a shutter cover 72 disposed so as to cover the arcing surface 53, and a shutter 73 disposed between the arcing surface 53 and shutter cover 72.

(2) Toner Seals

As shown in FIG. 12, one of the toner seals 71 is provided for each main-body-side communication through-hole 58. The toner seal 71 has a sheet-like form with an opening 74. The area of the opening 74 is greater than the area of the corresponding main-body-side communication through-hole 58. Thus, the toner seals 71 are fixed to the arcing surface 53 of the main body 51 so that the openings 74 are aligned and in communication with the corresponding main-body-side communication through-holes 58 and, hence, encircle the main-body-side communication through-holes 58.

Figure 13:
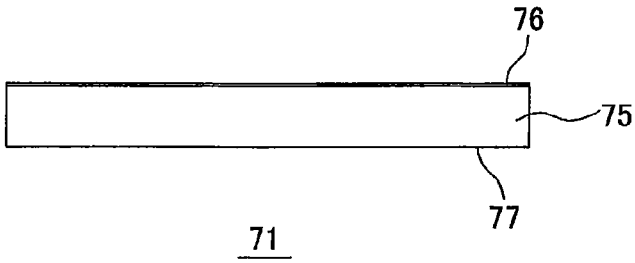
FIG. 13 is a side view of a toner seal shown in FIG. 12.

As shown in FIG. 13, each toner seal 71 has a laminated structure (two-layer structure) configured of an elastic layer 75, and a mesh layer 76 disposed on one surface of the elastic layer 75.

Figure 22:
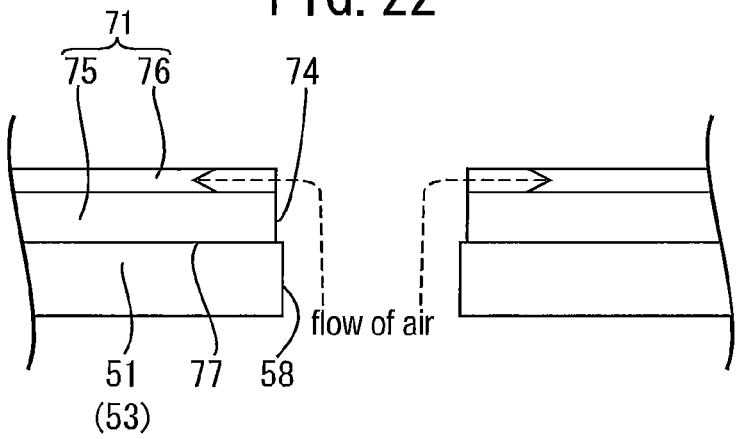
FIG. 22 illustrates how air flows out of the toner box.

The elastic layer 75 is formed of a resilient foam material, such as the product PORON® (trade name, registered trade mark) manufactured by Rogers Inoac Corporation. The elastic layer 75 is formed much thicker than the mesh layer 76. A fixing surface 77 constituting the surface of the elastic layer 75 opposite the mesh layer 76 is fixed to the arcing surface 53 of the main body 51 with adhesive as shown in FIG. 22.

Figure 14:
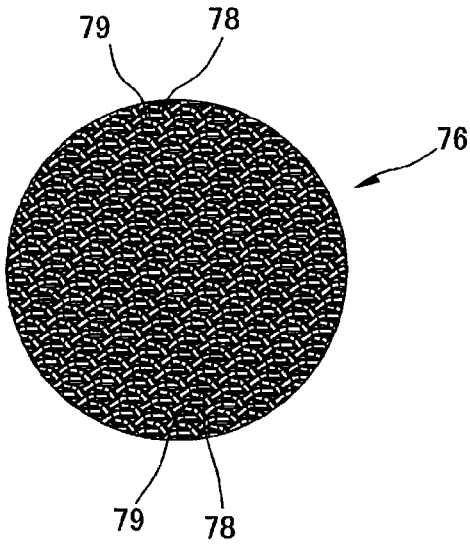
FIG. 14 is a partial perspective view of the surface of a mesh layer shown in FIG. 13.
Figure 15:
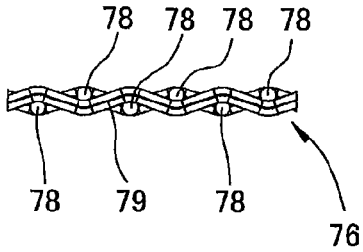
FIG. 15 is a cross-sectional view of the mesh layer.

FIG. 14 shows a surface portion of the mesh layer 76, while FIG. 15 shows a cross-sectional portion of the same. As shown in the drawings, the mesh layer 76 includes warp fibers 78 and weft fibers 79 interlaced in a plain weave (an alternating over and under pattern). The gaps between adjacent warp fibers 78 and the gaps between adjacent weft fibers 79 are greater than or equal to 15 μm and smaller than or equal to 50 μm and preferably greater than or equal to 25 μm and smaller than or equal to 40 μm.

As shown in FIGS. 16A and 16B, the portion of the toner seal 71 disposed forward of the main-body-side communication through-hole 58 (on the front end side of the arcing surface 53) has a width D1 along the circumferential direction of the arcing surface 53. The portion of the toner seal 71 disposed rearward of the main-body-side communication through-hole 58 (on the rear end side of the arcing surface 53) has a width D2 along the circumferential direction of the arcing surface 53. The width D1 is greater than the width D2.

(3) Shutter Cover

The shutter cover 72 is curved to conform to the arcing surface 53 of the main body 51. The shutter cover 72 is formed of a resin film that is thinner than the thickness of the shutter 73. More specifically, the shutter cover 72 has a thickness greater than or equal to 0.03 mm and smaller than or equal to 0.3 mm, and preferably greater than or equal to 0.08 mm and smaller than or equal to 0.2 mm. The left-to-right dimension of the shutter cover 72 is approximately equal to the same dimension of the arcing surface 53, so that the shutter cover 72 covers the arcing surface 53 across substantially the entire width in the left-to-right direction.

As shown in FIG. 12, a plurality of positioning openings 80 is formed in the front edge portion of the shutter cover 72 at intervals in the left-to-right direction. As shown in FIGS. 17A and 17B, the positioning protrusions 60 formed on the arcing surface 53 of the main body 51 are engaged in the positioning openings 80. More specifically, the positioning openings 80 are formed in the front edge portion of the shutter cover 72 at positions in the left-to-right direction corresponding to the positioning protrusions 60 and of a sufficient size for inserting the positioning protrusions 60. After the positioning protrusions 60 are inserted into the corresponding positioning openings 80, the top edges of the positioning openings 80 engage the positioning protrusions 60.

The rear edge part of the shutter cover 72 is folded back to conform to the fixing surface 54 of the main body 51. A plurality of screw insertion through-holes 81 are formed in this rear edge portion of the shutter cover 72 at intervals in the left-to-right direction, as shown in FIG. 12. As shown in FIGS. 16A and 16B, the shutter cover 72 is attached to the main body 51 by engaging the positioning protrusions 60 in the respective positioning openings 80, and by inserting screws 82 through all of the screw insertion through-holes 81 and screwing the tips of the screws 82 into the fixing surface 54 of the main body 51.

As shown in FIGS. 11 and 12, cover-side communication through-holes 83 are formed in the shutter cover 72 at positions corresponding to the toner seals 71. Each of the cover-side communication through-holes 83 has a rectangular shape and is elongated in the left-to-right direction. Further, the cover-side communication through-hole 83 has a greater open area than the area of the main-body-side communication through-hole 58 so as to expose the main-body-side communication through-hole 58 in its entirety. The size of each cover-side communication through-hole 83 is such that when the shutter 73 is in an open position (described later), as shown in FIG. 16A, a gap is formed between the rear edge of the corresponding toner seal 71 and the rear edge of the cover-side communication through-hole 83, gaps are formed between the left and right edges of the corresponding toner seal 71 and the left and right edges of the cover-side communication through-hole 83, and the front edge of the corresponding toner seal 71 is interposed between the shutter cover 72 and the arcing surface 53 of the main body 51. Consequently, when the shutter 73 is in the open position, the shutter cover 72 does not cover the rear edge and both left and right edges of the toner seal 71, allowing these edges to protrude outward through the cover-side communication through-hole 83.

As shown in FIG. 12, slanted parts 84 having portions angled relative to the circumferential direction of the shutter cover 72 are formed on the shutter cover 72 in both rear side corners of each cover-side communication through-hole 83 as part of the peripheral edge of the cover-side communication through-hole 83. With the slanted parts 84, the left-to-right width of each cover-side communication through-hole 83 grows narrower toward the rear edge of the shutter cover 72.

The part of each slanted part 84 forming a peripheral edge portion of each cover-side communication through-hole 83 may extend in a straight line or follow a gentle curve, provided that the portion is slanted relative to the circumferential direction of the shutter cover 72. These portions of the slanted parts 84 are shaped in a gentle curve in the example of FIG. 12.

Guide slits 85 elongated in the front-to-rear direction (circumferential direction of the shutter cover 72) are formed in the shutter cover 72 at positions corresponding to the relief grooves 59 formed in the main body 51. The guide slits 85 have a front-to-rear length that is greater than or equal to the front-to-rear length of the relief grooves 59. The left-to-right width of the guide slits 85 is also greater than or equal to the left-to-right width of the relief grooves 59. Each guide slit 85 confronts the corresponding relief groove 59 in its entirety.

Locking member insertion through-holes 86 and 87 are also formed in the shutter cover 72 at positions corresponding to the recessions 61 and 62 formed in the main body 51.

(4) Shutter

As shown in FIG. 12, the shutter 73 curves along the arcing surface 53 of the main body 51. The shutter 73 is formed of a resin film having a width in the left-to-right direction slightly smaller than the left-to-right width of the shutter cover 72. The dimension of the shutter 73 along the circumferential direction of the arcing surface 53 is greater than the same dimension of the toner seals 71 and is set such that the shutter 73 does not contact the fixing surface 54 and the positioning protrusions 60 when moving between an open position and a closed position described later.

The shutter 73 may not be formed of a resin film. However, the shutter 73 is preferably made from a film-shaped material that has a thickness smaller than or equal to 250 micrometers (μm) and that has a sufficient degree of flexibility or pliability so that the film-shaped material can be rolled up.

Two shutter drive openings 88 separated by a prescribed interval in the circumferential direction of the shutter 73 are formed in the shutter 73 at positions opposing each relief groove 59 in the main body 51. The distance between the two shutter drive openings 88 at each position is set such that all shutter drive openings 88 confront a corresponding relief groove 59 and confront and communicate with a corresponding guide slit 85 formed in the shutter cover 72, regardless of whether the shutter 73 is in the open position or the closed position.

V-shaped notches 89 are formed in the rear edge of the shutter 73 (the edge of the shatter 73 on the rear edge side of the arcing surface 53) at positions in the left-to-right direction corresponding to the main-body-side communication through-holes 58 formed in the main body 51. The V-shaped notches 89 open toward the rear edge side of the arcing surface 53. Forming the V-shaped notches 89 in this way, produces sloped parts (slanted parts) 90 in the rear edge of the shutter 73 that are angled relative to the circumferential direction of the shutter 73.

Locking openings 91 and 92 are also formed in the shutter 73 at positions opposing the recessions 61 and 62 formed in the main body 51 when the shutter 73 is in the closed position. Hence, when the shutter 73 is in the closed position, the locking openings 91 and 92 confront the recessions 61 and 62, respectively, and also confront the respective locking member insertion through-holes 86 and 87 formed in the shutter cover 72. Accordingly, the recession 61 and locking member insertion through-hole 86 are in communication via the locking opening 91, and the recession 62 and locking member insertion through-hole 87 are in communication via the locking opening 92.

The shutter 73 is interposed between the arcing surface 53 of the main body 51 and the shutter cover 72. While held between the arcing surface 53 and shutter cover 72, the shutter 73 can move between an open position and a closed position described next.

(5) Open Position of the Shutter

In the open position shown in FIG. 16A, the shutter 73 is positioned on the front side of the cover-side communication through-holes 83 formed in the shutter cover 72. More specifically, when the shutter 73 is in the open position, the rear edge of the shutter 73 is positioned farther forward than the front edges of the cover-side communication through-holes 83, and the rear edge portion of the shutter 73 is interposed between the front edge portion of the toner seal 71 and the shutter cover 72. Therefore, each main-body-side communication through-hole 58 formed in the main body 51 and the opening 74 formed in the corresponding toner seal 71 are made open, while being in communication with each other. This provides communication between the interior and exterior of the main body 51. Further, since the rear edge and both left and right edges of the toner seal 71 are exposed, these edges protrude outward through the cover-side communication through-hole 83.

(6) Closed Position of the Shutter

In the closed position shown in FIG. 16B, the shutter 73 is positioned farther rearward than the open position. When the shutter 73 is in the closed position, the rear edge of the shutter 73 is positioned slightly rearward than the rear edges of the cover-side communication through-holes 83. Accordingly, the shutter 73 opposes nearly the entire area of the cover-side communication through-holes 83, excluding the regions opposite the V-shaped notches 89 formed in the shutter 73, and contacts the shutter cover 72 in the peripheral portions of the cover-side communication through-holes 83. The toner seals 71 are entirely interposed between the shutter 73 and the arcing surface 53 of the main body 51. As a result, the shutter 73 covers the main-body-side communication through-holes 58 formed in the main body 51 and the openings 74 formed in the toner seals 71 in their entirety, blocking communication between the interior and exterior of the main body 51.

4. Mounting the Toner Box

Each toner box 11 is mounted in or removed from the corresponding space 12 formed above the partitioning wall 42 of the developing unit frame 8 (see FIG. 7) when the corresponding shutter 73 is in the closed position.

When a toner box 11 is not mounted in the corresponding space 12, the opening member 26 is in the first position shown in FIG. 5A and the closing member 32 is in the fourth position shown in FIG. 5B. The corresponding shutter drive member 44 above the partitioning wall 42 is positioned opposite the rectangular openings 43 formed in the partitioning wall 42, as shown in FIGS. 7 and 8.

With the drawer unit 3 (drawer frame 21) pulled out of the main casing 2 to the withdrawn position (see FIG. 1), the toner box 11 is mounted into the corresponding space 12 from above. At this time, the shutter drive protrusions 47 positioned closer to the front side among the pairs of shutter drive protrusions 47 formed in the shutter drive member 44 protrude upward along a substantially vertical direction, while the shutter drive protrusions 47 positioned closer to the rear protrude in a direction angled upward and forward, as shown in FIG. 17B. When the toner box 11 is mounted in the space 12, each of the shutter drive protrusions 47 engages in a corresponding shutter drive opening 88 through the corresponding guide slit 85.

While the drawer unit 3 remains in the withdrawn position, an operator next moves the opening member 26 from the first position shown in FIG. 5A to the second position shown in FIG. 4A, causing the shutter drive member 44 to move from a position confronting the rectangular openings 43 to a position not confronting the rectangular openings 43 (see FIG. 17A). In association with the movement of the shutter drive member 44, the shutter 73 moves forward from the closed position to the open position.

As shown in FIG. 8, annular frame seals 93 are disposed on top of the partitioning wall 42 at positions corresponding to each of the toner seals 71. That is, the annular frame seals 93 are disposed on a surface of the partitioning wall 42 confronting the corresponding space 12 at positions corresponding to each of the toner seals 71. The annular frame seals 93 surround the periphery or perimeter of each rectangular opening 43. When the shutter 73 is in the open position, the rear edge and both left and right edges of each toner seal 71 protrudes outward through the corresponding cover-side communication through-hole 83. The protruding portions of the toner seal 71 directly press against the corresponding frame seal 93, and portions of the frame seal 93 that do not contact the toner seal 71 contact the shutter cover 72. Therefore, the opening 74 formed in each toner seal 71 is in communication with the corresponding rectangular opening 43 through the opening region in the corresponding frame seal 93, while the toner seal 71 and frame seal 93 seal any gaps formed between the partitioning wall 42 and shutter cover 72.

After all toner boxes 11 have been mounted in the corresponding spaces 12, all opening members 26 have been shifted from their first positions to their second positions, and the shutters 73 of all toner boxes 11 are in their open positions, the toner boxes 11 supply toner to all corresponding developing units 7. Subsequently, the operator pushes the drawer unit 3 to the accommodated position within the main casing 2 and closes the front cover 4 (see FIG. 1). At this time, the user can begin performing image-forming operations with the color printer 1.

In order to remove a toner box 11 from the drawer unit 3, the operator opens the front cover 4 and pulls the drawer unit 3 outward from the accommodated position to the withdrawn position. Next, the operator shifts the closing member 32 for the desired toner box 11 from the third position shown in FIG. 4B to the fourth position shown in FIG. 5B. This movement of the closing member 32 moves the shutter drive member 44 from a position not confronting the rectangular openings 43 to a position confronting the rectangular openings 43 (see FIG. 17B). In association with the movement of the shutter drive member 44, the shutter 73 moves rearward from the open position to the closed position.

Next, the operator removes the toner box 11 from the space 12. Since the shutter 73 is in the closed position at this time, there is no risk of toner spilling out of the main body 51 when the toner box 11 is removed.

5. Locking Mechanism

Since the shutter drive protrusions 47 are not engaged in the shutter drive openings 88 when the toner box 11 has been removed from the drawer unit 3, the shutter 73 can move freely relative to the main body 51 and shutter cover 72. Therefore, if the toner box 11 were jolted, shaken, or the like, the shutter 73 could move out of the closed position.

Figure 18A:
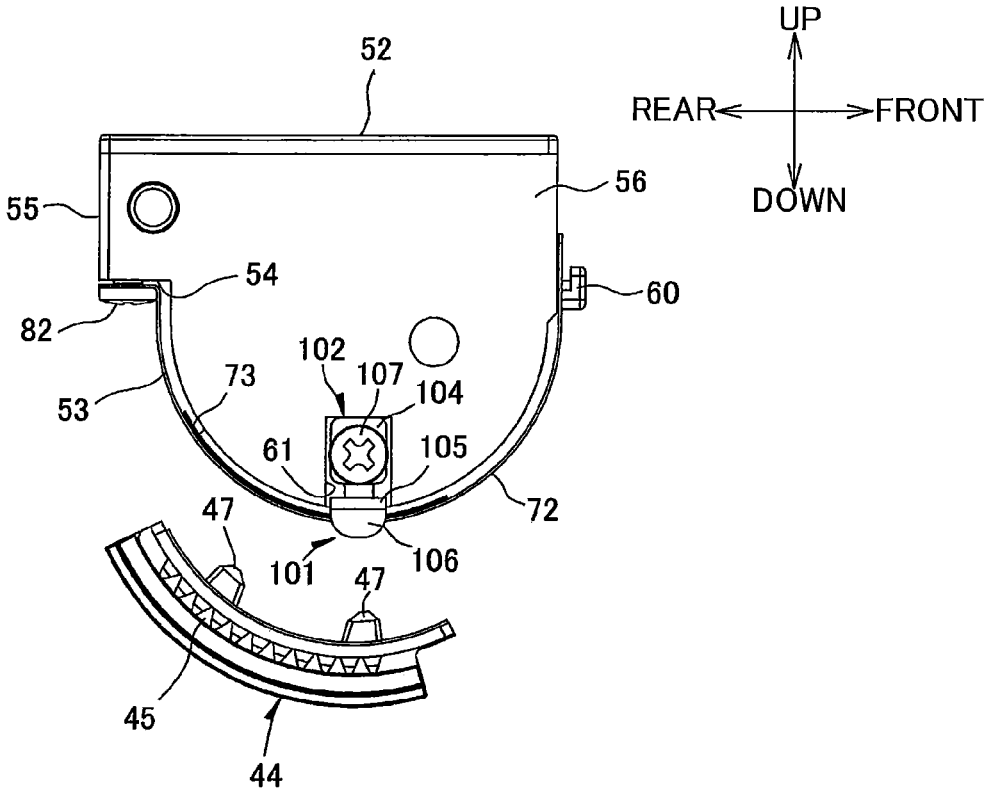
FIG. 18A is a left side view of the toner box in FIG. 11 and the shutter drive member in FIG. 7 showing the state of a locking mechanism before the toner box has been coupled with the shutter drive member.
Figure 18B:
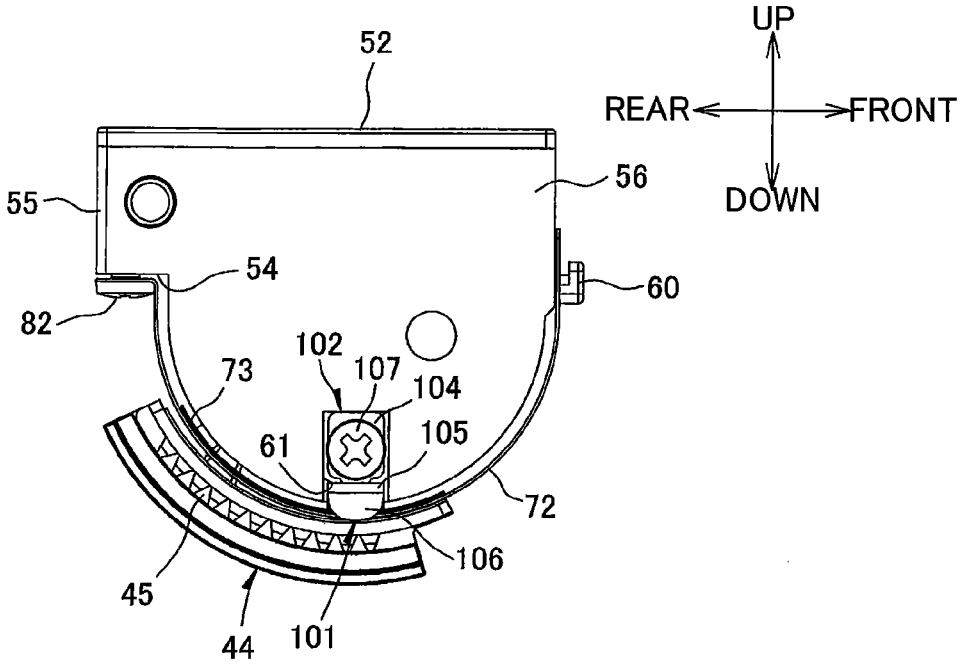
FIG. 18B is a left side view of the toner box in FIG. 11 and the shutter drive member in FIG. 7 showing the state of the locking mechanism after the toner box has been coupled with the shutter drive member.

In order to fix the shutter 73 in the closed position while the toner box 11 is removed from the drawer unit 3, the toner box 11 in the embodiment has a locking mechanism 101 provided in each of the recessions 61 and 62, as shown in FIGS. 18A and 18B. Since the locking mechanism 101 disposed in the recession 61 and the locking mechanism 101 disposed in the recession 62 have the same structure, except in mirror image, the locking mechanism 101 disposed in the recession 61 will be used below for a collective description of the locking mechanisms 101.

Figure 19:
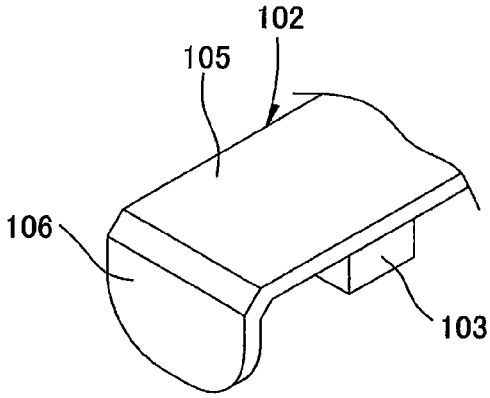
FIG. 19 is a partial perspective view of the locking mechanism shown in FIGS. 18A and 18B.

As shown in FIG. 19, the locking mechanism 101 includes an arm 102, and a locking protrusion 103 attached to the arm 102.

The arm 102 is configured of a flexible thin plate, such as a leaf spring. The arm 102 has the shape of a crank. That is, beginning from one end, the arm 102 extends downward within the recession 61, then bends and extends leftward, and finally bends and extends downward. More specifically, as shown in FIGS. 18A and 18B, the arm 102 is integrally formed of a fixing part 104 extending downward within the recession 61, a holding part 105 extending leftward from the bottom edge of the fixing part 104, and a contact part 106 extending downward from the left edge of the holding part 105. The fixing part 104 is fixed to the leftward-facing surface of the main body 51 inside the recession 61 by a screw 107.

As shown in FIG. 19, the locking protrusion 103 has a flattened square pillar shape and is fixed to the bottom surface of the holding part 105. When the shutter 73 is in the closed position, the locking protrusion 103 on the bottom surface of the holding part 105 is disposed in a position opposing the locking opening 91 formed in the shutter 73.

Figure 20A:
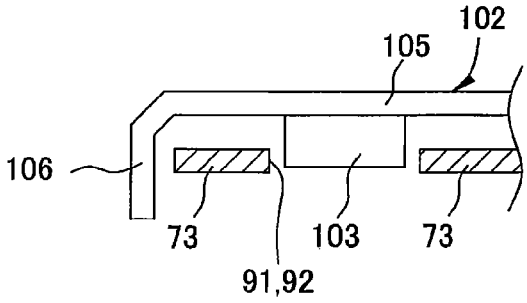
FIG. 20A is a cross-sectional view of the shutter and locking mechanism when the shutter is fixed by the locking mechanism.

Accordingly, when the toner box 11 has been removed from the drawer unit 3, the locking protrusions 103 of both locking mechanisms 101 are respectively inserted into the locking openings 91 and 92 formed in the shutter 73, as shown in FIGS. 18A and 20A, thereby preventing the shutter 73 from moving out of the closed position. Accordingly, the locking mechanisms 101 prevent the shutter 73 from moving out of the closed position while the toner box 11 has been removed from the drawer unit 3.

Figure 20B:
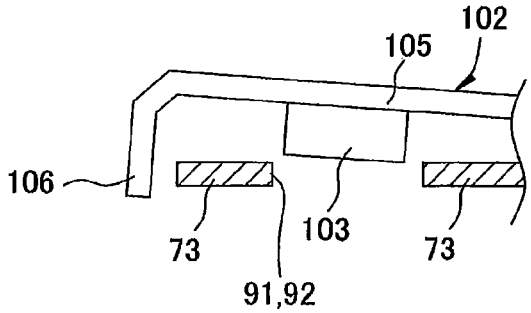
FIG. 20B is a cross-sectional view of the shutter and locking mechanism when the shutter is not fixed by the locking mechanism.

When the toner box 11 is mounted in a corresponding space 12 provided in the drawer unit 3, the bottom edge of the contact part 106 contacts the top surface of the shutter drive member 44 (the top surface of the plate-shaped part 441 or 444) during the mounting operation, as shown in FIGS. 18B and 20B. Thus, as the toner box 11 is moved farther in the mounting direction, the force of resistance received from the shutter drive member 44 causes the holding part 105 of the arm 102 to deform, bending so that the left end of the holding part 105 rises upward. Consequently, the locking protrusions 103 are extracted from the locking openings 91 and 92. At this time, the shutter 73 can move freely relative to the main body 51 and shutter cover 72 and can move together with the shutter drive member 44.

6. Operations (1) As described above, the toner box 11 is provided with a main body 51 for accommodating toner. The main-body-side communication through-holes 58 are formed in the main body 51 for allowing communication between the interior and exterior of the same. The shutter 73 is provided for opening and closing the main-body-side communication through-holes 58. That is, the shutter 73 is capable of moving between an open position in which the shutter 73 does not block the main-body-side communication through-holes 58 and a closed position in which the shutter 73 blocks the main-body-side communication through-holes 58.

Since the shutter 73 is formed of a relatively thin film, rather than a relatively thick product, such as those formed by molding or metalworking, any toner present in the main-body-side communication through-holes 58 does not come to rest on the edge of the shutter 73 when the shutter 73 is moved from the open position to the closed position. Hence, after the toner box 11 has been removed from the developing unit 7, the configuration of the shutter 73 prevents toner from spilling out of the toner box 11 (off the edge of the shutter 73), thereby preventing toner from soiling the inside and outside of the main casing 2.

Figure 21A:
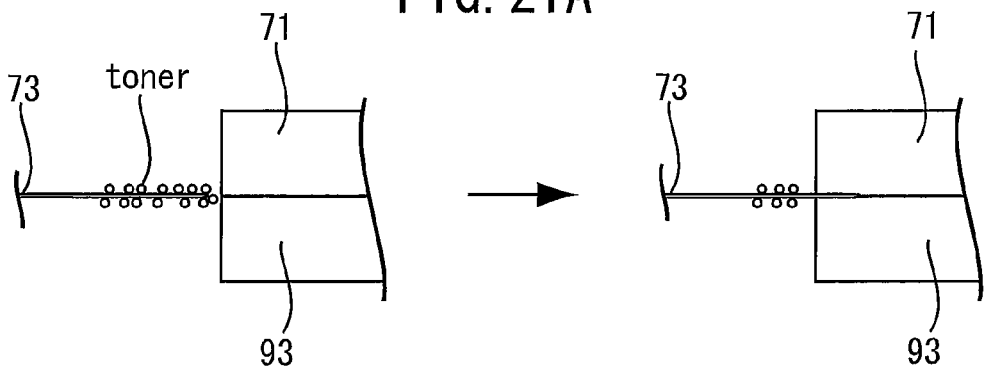
FIG. 21A illustrates how toner on the shutter is scraped off by the toner seal and an annular frame seal when the shutter enters between the toner seal and the annular frame seal.
Figure 21B:
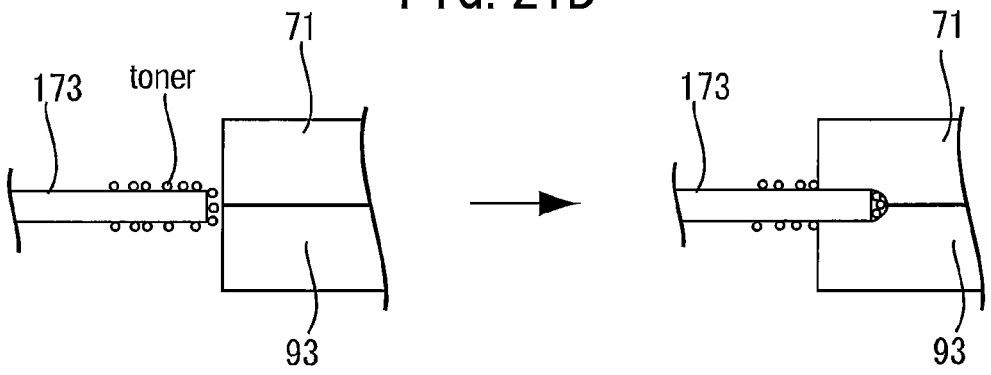
FIG. 21B illustrates how toner on an edge of a shutter according to a comparative example enters between the toner seal and the annular frame seal when the shutter enters between the toner seal and the annular frame seal.

More specifically, when the toner box 11 is mounted in the developing unit 7, the toner seal 71 on the toner box 11 side and the annular frame seal 93 on the developing unit 7 side closely contact with each other to form a seal therebetween. When the shutter 73 is moved from the open position to the closed position, an edge of the shutter 73 enters between the toner seal 71 and the annular frame seal 93. At that time, toner rest on the surfaces of the shutter 73 is scraped off by the toner seal 71 and the annular frame seal 93 because the shutter 73 is formed of a thin film shape as shown in FIG. 21A. So, toner does not enter between the toner seal 71 and the annular frame seal 93. This prevents toner from dropping off the shutter 73 of the toner box 11 when the toner box 11 is detached from the annular frame seal 93 of the developing unit 7. On the other hand, now assume that the shutter 73 were formed of a relatively thick product, such as a molded resin or a metal plate, as indicated by a comparative shutter 173 shown in FIG. 21B. In such a case, when the comparative shutter 173 enters between the toner seal 71 and the annular frame seal 93, toner rest on the edge of the comparative shutter 173 will enter a space surrounded by the edge of the comparative shutter 173, toner seal 71, and annular frame seal 93. So, toner enters between the toner seal 71 and the annular frame seal 93. The toner will drop off the comparative shutter 173 when the toner box having the comparative shutter 173 is detached from the annular frame seal 93 of the developing unit 7.

Additionally, being formed of a film, the shutter 73 is deformable for conforming to the shape of the main body 51 and can move along the surface of the main body 51 in this deformed state. Hence, only a small amount of space is required for opening and closing the shutter 73. This allows for increased freedom in the peripheral shape of the main-body-side communication through-holes 58 and can help make the structure around the developing units 7 more compact.

Further, the shutter 73 contacts the toner seals 71 with general uniformity of pressure, rather than with strong pressure in specific areas. This structure ensures smooth movement of the shutter 73 and improves the close contact between the shutter 73 and toner seals 71, thereby reliably preventing toner leakage.

Further, the shutter drive openings 88 are formed in the shutter 73 for engaging the shutter drive protrusions 47 provided on the developing unit 7. When the shutter drive protrusions 47 are moved while engaged in the shutter drive openings 88, the shutter 73 moves together with the shutter drive protrusions 47. Hence, through a simple construction, it is possible to move the shutter 73 from the open position to the closed position.

It is also possible to configure the structure for moving the shutter 73 such that the shutter drive protrusions are disposed on the shutter 73 and the shutter drive openings that engage with these protrusions are formed in the developing unit 7.

However, when a toner box 11 having this structure is removed from the developing unit 7, the operator might accidentally catch a finger on one of the shutter drive protrusions and could easily move the shutter 73 from the closed position into the open position. Since it is more difficult to catch a finger on one of the shutter drive openings 88, forming the shutter drive openings 88 in the shutter 73 can prevent the shutter 73 from being moved from the closed position to the open position while the toner box 11 is out of the developing unit 7. Accordingly, the structure of the embodiment can better prevent the leakage of toner from the toner box 11.

(2) The shutter drive openings 88 are formed on both sides of each main-body-side communication through-hole 58 relative to a direction orthogonal to the direction in which the shutter 73 moves, i.e., both left and right sides of each main-body-side communication through-hole 58. Accordingly, the shutter drive protrusions 47 can provide a drive force to the shutter 73 for moving the same, which force is balanced in the left-to-right direction, thereby achieving stable movement of the shutter 73.

(3) Further, relief grooves 59 are formed in the main body 51 at positions corresponding to the shutter drive openings 88. Accordingly, the tips of the shutter drive protrusions 47 inserted through the shutter drive openings 88 can be inserted into the corresponding relief grooves 59 to ensure reliable engagement between the shutter drive protrusions 47 and shutter drive openings 88. Further, since the relief grooves 59 are elongated in the moving direction of the shutter 73, the shutter 73 can be moved while maintaining the engaged state of the shutter drive protrusions 47 and shutter drive openings 88.

(4) A plurality of the main-body-side communication through-holes 58 is formed in the main body 51 to facilitate the supply of toner from the interior of the main body 51 to the developing unit 7, ensuring that a large quantity of toner is supplied to the developing unit 7.

(5) The sloped parts 90 that are sloped at an angle to the moving direction of the shutter 73 are formed in a leading edge of the shutter 73 relative to the direction (closing direction) in which the shutter 73 moves from the open position to the closed position. Accordingly, the surface area of the shutter 73 contacting the toner seal 71 in the width direction increases gradually as the shutter 73 moves from the open position to the closed position. This configuration prevents a sudden increase in the width of the shutter 73 contacting the toner seal 71, thereby preventing a sudden increase in resistance to the movement of the shutter 73. As a result, the addition of the sloped parts 90 ensures motion of the shutter 73.

With a comparative configuration in which the leading edge of the shutter 73 in the closing direction extends in a straight line (i.e., a structure having no sloped parts 90), there is a risk that this edge of the shutter 73 will catch on the toner seal 71 when the shutter 73 is moving from the open position to the closed position, hindering this movement. However, by providing the sloped parts 90 as described in the embodiment, the sloped parts 90 move diagonally to the toner seal 71 when the shutter 73 is moved from the open position to the closed position, preventing the edge of the shutter 73 from catching on the toner seal 71.

(6) Further, locking protrusions 103 protrude from the main body 51 toward the shutter 73, and locking openings 91 and 92 are formed in the shutter 73 at positions corresponding to the locking protrusions 103. The locking protrusions 103 are engaged in the locking openings 91 and 92 when the shutter 73 is in the closed position, thereby preventing the shutter 73 from moving out of the closed position. Accordingly, this structure reliably prevents movement of the shutter 73 while the toner box 11 is detached from the developing unit 7 and can better prevent toner from leaking out of the toner box 11.

(7) The shutter 73 is covered by the shutter cover 72, which prevents the operator from directly touching the shutter 73 and moving the shutter 73 from the closed position to the open position while the toner box 11 is detached from the developing unit 7. Accordingly, this structure can better prevent toner from leaking out of the toner box 11.

(8) The guide slits 85 are formed in the shutter cover 72 at positions corresponding to the shutter drive openings 88. Therefore, after the shutter drive protrusions 47 are inserted through the guide slits 85, the portions of the shutter drive protrusions 47 protruding from the other side of the guide slits 85 can engage with the shutter drive openings 88. Since the guide slits 85 extend in the moving direction of the shutter 73, the shutter drive protrusions 47 can move within the guide slits 85 while remaining engaged with the shutter drive openings 88. Accordingly, by providing the shutter cover 72, the shutter 73 can be moved while maintaining the engaged state of the shutter drive protrusions 47 and shutter drive openings 88.

(9) Further, the cover-side communication through-holes 83 are formed in the shutter cover 72 at positions corresponding to the main-body-side communication through-holes 58. Hence, when the main-body-side communication through-holes 58 are open, toner can be supplied from the interior of the main body 51 to the developing unit 7 through the main-body-side communication through-holes 58 and the cover-side communication through-holes 83.

(10) The area of each cover-side communication through-hole 83 is larger than the area of the corresponding main-body-side communication through-hole 58, and thus, the main-body-side communication through-hole 58 can be exposed in its entirety in the corresponding cover-side communication through-hole 83. Hence, this structure prevents the shutter cover 72 from hindering the supply of toner from the interior of the main body 51 to the developing unit 7.

(11) Further, the slanted parts 84 formed on the shutter cover 72 have a portion that slants at an angle to the moving direction of the shutter 73 as part of the peripheral edge of the corresponding cover-side communication through-holes 83. Consequently, the width of each cover-side communication through-hole 83 in the direction orthogonal to the moving direction of the shutter 73 grows narrower toward the downstream side of the closing direction, i.e., the direction in which the shutter 73 is moved from the open position to the closed position. Accordingly, the surface area of the shutter 73 that contacts the shutter cover 72 in the width direction gradually increases when the shutter 73 moves from the open position to the closed position, thereby preventing a sudden increase in the area of contact between the shutter 73 and shutter cover 72 and, hence, preventing a sudden increase in resistance to the movement of the shutter 73. Therefore, this structure ensures smooth movement of the shutter 73.

If the cover-side communication through-holes 83 were formed in a perfect rectangular shape without forming the slanted parts 84 on the shutter cover 72, the leading edge of the shutter 73 relative to the closing direction could catch on the peripheral edges of the cover-side communication through-holes 83 formed in the shutter cover 72 when the shutter 73 moves from the open position to the closed position, thereby hindering movement of the shutter 73. However, when the slanted parts 84 are formed on the shutter cover 72, the slanted parts 84 move along a diagonal relative to the leading edge of the shutter 73 in the closing direction when the shutter 73 moves from the open position to the closed position. Hence, the slanted parts 84 can prevent the leading edge of the shutter 73 from catching on the peripheral edge of the cover-side communication through-holes 83.

(12) The shutter cover 72 is formed thinner than the shutter 73. Therefore, it is possible to provide the shutter cover 72 while still maintaining only a small gap between the main body 51 and developing unit 7, thereby ensuring that toner is smoothly supplied from the interior of the main body 51 to the developing unit 7.

(13) The shutter cover 72 is formed of a film having a thickness within a range between 0.03 and 0.3 mm, and preferably between 0.08 and 0.2 mm. By using a film of this thickness, the shutter cover 72 can be made elastically deformable. It is noted that the shutter cover 72 may not be formed of a film.

Since the shutter cover 72 is elastically deformable, the shutter cover 72 can deform to absorb a reaction force that the shutter 73 receives from the toner seal 71 when the shutter 73 compresses the toner seal 71 while advancing between the toner seal 71 and shutter cover 72 from the open position to the closed position. Thus, the elastically deformable shutter cover 72 allows the shutter 73 to move smoothly between the open position and closed position. Further, the shutter cover 72 can deform in order to conform to the shape of the developing unit 7 (shutter drive member 44). Hence, the shutter cover 72 having this structure can eliminate dead space between the toner box 11 and developing unit 7, which is conducive to making the structure including the toner box 11 and developing unit 7 more compact and, thus, the color printer 1 more compact.

The shutter cover 72 can be made elastically deformable even though the shutter cover 72 is not formed of a film. For example, the shutter cover 72 can be made elastically deformable by being formed of a stainless steel plate of a thickness of 0.1 mm, for example.

(14) The positioning protrusions 60 formed on the main body 51 protrude from the main body 51 toward the shutter cover 72. The positioning openings 80 are formed in the shutter cover 72 for engaging with the positioning protrusions 60. Through the engagement between the positioning protrusions 60 and positioning openings 80, the shutter cover 72 can be positioned relative to the main body 51. Accordingly, the shutter cover 72 can be easily mounted on the main body 51 when assembling the toner box 11.

In the shutter cover 72, the positioning openings 80 are formed through the shutter cover 72 as through-holes. However, recessions may be formed in the shutter cover 72 instead of the through-holes so that an inlet of each recession functions as the positioning opening 80.

(15) The right and left rack gears 45 and 46 are formed on the resinous plate-shaped parts 441 and 444 of the shutter drive member 44 for receiving a drive force for moving the shutter 73. Providing the rack gears 45 and 46 on the resinous plate-shaped parts 441 and 444 simplifies formation of the rack gears 45 and 46. By inputting a drive force into the rack gears 45 and 46, the drive force can move the shutter drive member 44, causing the shutter 73 to move between the open position and closed position in association with the movement of the shutter drive member 44.

(16) The toner seals 71 encircle the main-body-side communication through-holes 58. That is, the toner seals 71 surround the perimeters or peripheries of the main-body-side communication through-holes 58. Each toner seal 71 has an elastic layer 75 provided with a fixing surface 77, and a mesh layer 76 disposed on the side of the elastic layer 75 opposite the fixing surface 77. The mesh layer 76 is configured to prevent the leakage of toner while allowing the passage of air so that air can escape from the main body 51 through the mesh layer 76 when the main body 51 deforms due to changes in temperature or the like. More specifically, as shown in FIG. 22, air comes out of the main body 51 through the main-body-side communication through-hole 58, and passes through the mesh layer 76 in a direction along the main body 51, before finally flowing out the outer edge of the toner seal 71. So, air can readily escape from the toner box 11. This can avoid an increase in the internal pressure of the main body 51 caused by deformation of the main body 51. Thus, the integrity of seals formed by each of the toner seals 71 can be maintained, preventing toner from leaking out through gaps between the main body 51 and shutter 73.

Since the shutter 73 slides over the mesh layer 76 of each toner seal 71 when moving between the open and closed positions, the shutter 73 can be moved with less torque than if the shutter 73 was sliding over the elastic layer 75 since the resistance generated by the mesh layer 76 is smaller.

(17) The mesh layers 76 are formed to allow air to pass in a direction along the main body 51. Hence, air can escape out of the main body 51 through the mesh layers 76 of the toner seals 71 even though the toner seals 71 are compressed between the main body 51 and shutter 73. Accordingly, this construction can maintain the integrity of the seals formed by the toner seals 71 while allowing air to escape from the main body 51.

(18) The gaps between adjacent fibers forming the mesh layer 76 are preferably at least 15 μm and no greater than 50 μm. By setting the gaps between fibers within this range, the mesh layer 76 can form an adequate seal against toner, while allowing the passage of air.

The gaps between adjacent fibers forming the mesh layer 76 are more preferably at least 25 μm and no greater than 40 μm. Within this range, the mesh layer 76 can form a better seal against toner, while still allowing the smooth passage of air.

(19) Since the mesh layer 76 is formed in a plain weave, gaps can be maintained on both sides of the warp fibers 78 and weft fibers 79 when the toner seal 71 is compressed between the main body 51 and shutter 73, allowing a uniform passage of air. Accordingly, air can adequately escape from the main body 51.

(20) The area of the opening or space 74 surrounded or encircled by each toner seal 71 is greater than the area of the corresponding main-body-side communication through-hole 58. Hence, the opening 74, which is the space encircled by the toner seal 71, exposes the corresponding main-body-side communication through-hole 58 in its entirety, thereby preventing the toner seal 71 from hindering the supply of toner from the interior of the main body 51 to the developing unit 7.

(21) When the shutter 73 is in the open position, the rear edge of the shutter 73 (i.e., the leading edge of the shutter 73 in the direction that the shutter 73 moves from the open position to the closed position) is positioned farther forward than the front edges of the cover-side communication through-holes 83. When the shutter 73 is in the closed position, the shutter 73 is covered by the portions of the shutter cover 72 encircling the cover-side communication through-holes 83. Therefore, the shutter 73 is covered by the shutter cover 72 across its entire width in the left-to-right direction (the direction orthogonal to the closing direction), regardless of whether the shutter 73 is in the open position or the closed position. Hence, even when stress is exerted on the shutter 73 for deforming the same, the shutter cover 72 can restrain such deformation, preventing deformation of the shutter 73 and preventing potential toner leakage caused by such deformation.

(22) Further, gaps are formed between the rear edges of the toner seals 71 (the downstream edges in the closing direction) and the rear edges of the corresponding cover-side communication through-holes 83 (the downstream edges in the closing direction) when the shutter 73 is in the open position. In other words, the rear edges of the toner seals 71 protrude into the corresponding cover-side communication through-holes 83 and are not covered by the shutter cover 72 when the shutter 73 is in the open position. Therefore, at least the rear edges of the toner seals 71 protrude out through the cover-side communication through-holes 83 when the shutter 73 is in the open position. The toner seals 71 protruding out through the cover-side communication through-holes 83 can contact the developing unit 7 (annular frame seals 93) when the toner box 11 is mounted in the developing unit 7, forming a seal between the toner box 11 and developing unit 7. This construction can reduce the gap between the main body 51 and developing unit 7, thereby further reducing the potential for toner leakage between these components.

(23) When the shutter 73 is in the open position, gaps are formed between both left and right side edges of each toner seal 71 (i.e., both edges of the toner seal 71 relative to a direction orthogonal to the closing direction) and both left and right edges of the corresponding cover-side communication through-hole 83. Hence, in addition to its rear edge, both left and right edges of the toner seal 71 are not covered by the shutter cover 72 when the shutter 73 is in the open position, enabling these three edges of the toner seal 71 to protrude out through the corresponding cover-side communication through-hole 83. Since this construction increases the contact surface area between the toner seals 71 and the developing unit 7 (annular frame seals 93) when the toner box 11 is mounted in the developing unit 7, this structure improves the seal formed by the toner seals 71 between the toner box 11 and developing unit 7.

(24) The portion of the toner seal 71 disposed forward of the main-body-side communication through-hole 58 (on the front end side of the arcing surface 53), that is, the portion of the toner seal 71 disposed on the upstream side of the main-body-side communication through-hole 58 in the closing direction has a width D1 along the circumferential direction of the arcing surface 53. The width D1 is greater than a width D2 along the circumferential direction of the arcing surface 53 for the portion of the toner seal 71 disposed on the rear side of the corresponding main-body-side communication through-hole 58 (the rear end side of the arcing surface 53), that is, for the portion of the toner seal 71 disposed on the downstream side of the main-body-side communication through-hole 58 in the closing direction.

Accordingly, when the front edge of the toner seal 71 is interposed between the shutter cover 72 and the main body 51, the rear edge of the toner seal 71 can be reliably exposed from the shutter cover 72.

(25) When the shutter 73 is in the open position, the rear edge of the shutter 73 (the leading edge in the closing direction) is interposed between the toner seals 71 and shutter cover 72 and, hence, this rear edge of the shutter 73 does not come off the toner seals 71 while the shutter 73 is in the open position. Accordingly, the shutter 73 can be moved smoothly from the open position to the closed position without catching on the toner seal 71.

(26) The shutter drive member 44 includes the main body part 111 formed of a resin, and the reinforcing plate 112 formed of a thin metal plate. By overlaying the reinforcing plate 112 on the main body part 111, it is possible to ensure sufficient rigidity of the shutter drive member 44 so that the shutter drive member 44 can move the shutter 73 with stability.

Further, the shutter drive protrusions 47 can be easily formed on the main body part 111 since the main body part 111 is formed of a resin material.

Further, by inserting the shutter drive protrusions 47 through the insertion through-holes 113 in the reinforcing plate 112, the reinforcing plate 112 can be fixed in position relative to the main body part 111 with the shutter drive protrusions 47 protruding from the reinforcing plate 112.

7. Variations of the Embodiment (1) First Variation

Figure 23:
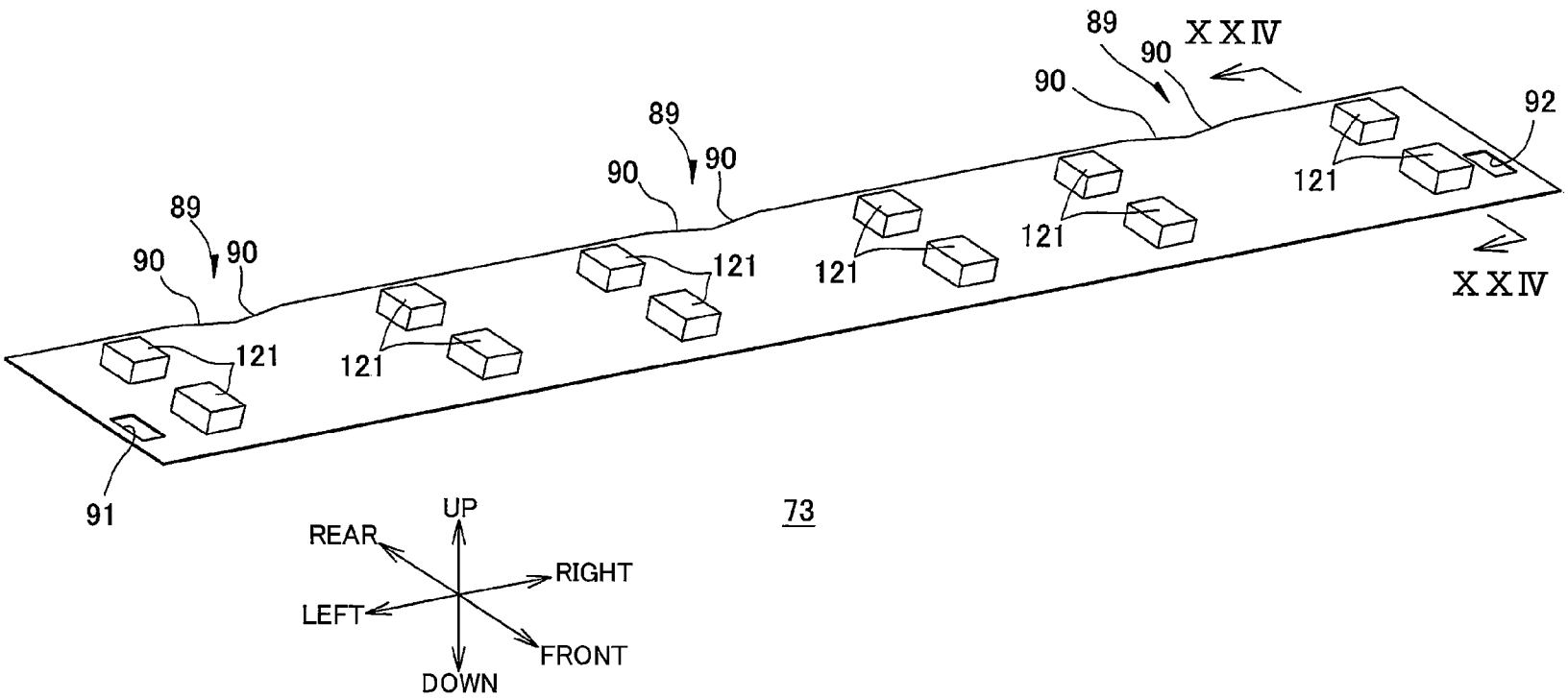
FIG. 23 is a perspective view showing a variation of the shutter according to the embodiment.
Figure 24:
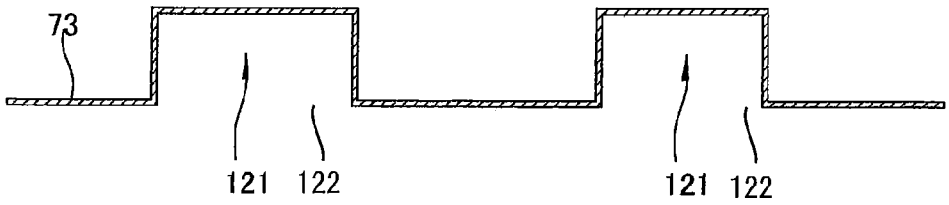
FIG. 24 is a cross-sectional view of the shutter according to the variation in FIG. 23 taken along the cross-sectional line XXIV-XXIV in FIG. 23.

The shutter 73 may have a structure as shown in FIGS. 23 and 24, instead of the structure shown in FIG. 12.

In the shutter 73 shown in FIG. 12, shutter drive openings 88 are formed through the shutter 73 for engaging the shutter drive protrusions 47 (see FIG. 10). However, in the shutter 73 shown in FIGS. 23 and 24, shutter drive recessions 121 are formed in the shutter 73 for engaging the shutter drive protrusions 47. With this construction, an inlet 122 for each shutter drive recession 121 functions as a shutter drive opening for being engaged with the corresponding shutter drive protrusion 47.

(2) Second Variation

Figure 25:
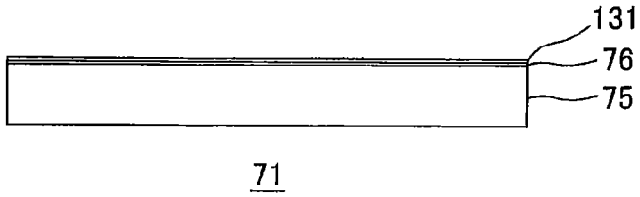
FIG. 25 is a side view showing a variation of the toner seal according to the embodiment.

The toner seal 71 may also have the structure shown in FIG. 25 and is not limited to the structure shown in FIG. 13.

The toner seal 71 described in the embodiment with reference to FIG. 13 has a two-layer structure including the elastic layer 75 and mesh layer 76. However, the toner seal 71 shown in FIG. 25 has an additional mesh layer 131 laminated on the mesh layer 76.

By providing the toner seal 71 with a plurality of mesh layers 76 and 131, air can more readily escape from the main body 51 of the toner box 11 (see FIG. 12).

(3) Third Variation

Figure 26:
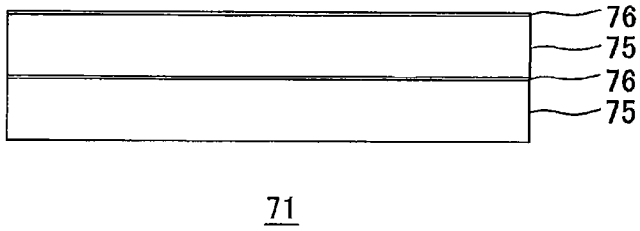
FIG. 26 is a side view showing another variation of the toner seal.

The toner seal 71 may also have the structure shown in FIG. 26. Here, the toner seal 71 has a laminated structure with four or more layers formed by alternately laminating the elastic layer 75 and mesh layer 76 one on the other. Also with this configuration, air can readily escape from the main body 51 of the toner box 11.

(4) Fourth Variation

Figure 27A:
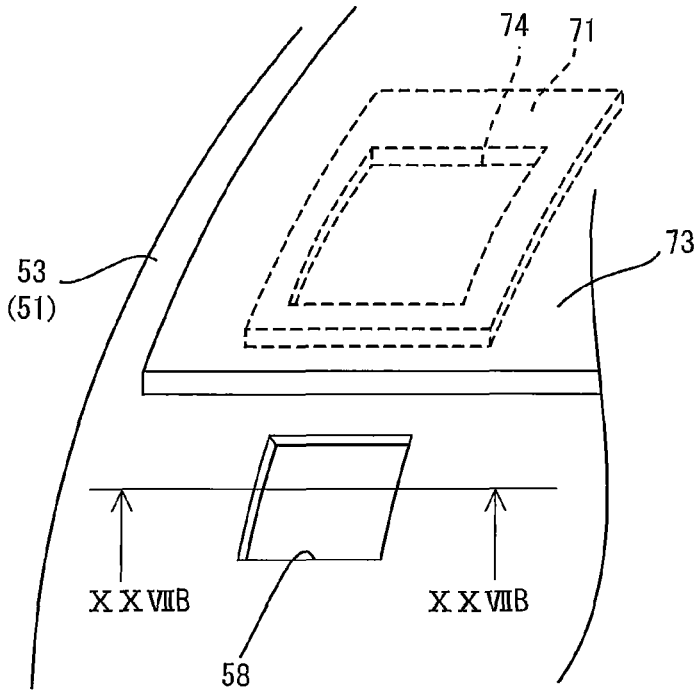
FIG. 27A illustrates how the toner seal is bonded to the shutter according to a variation.
Figure 27B:
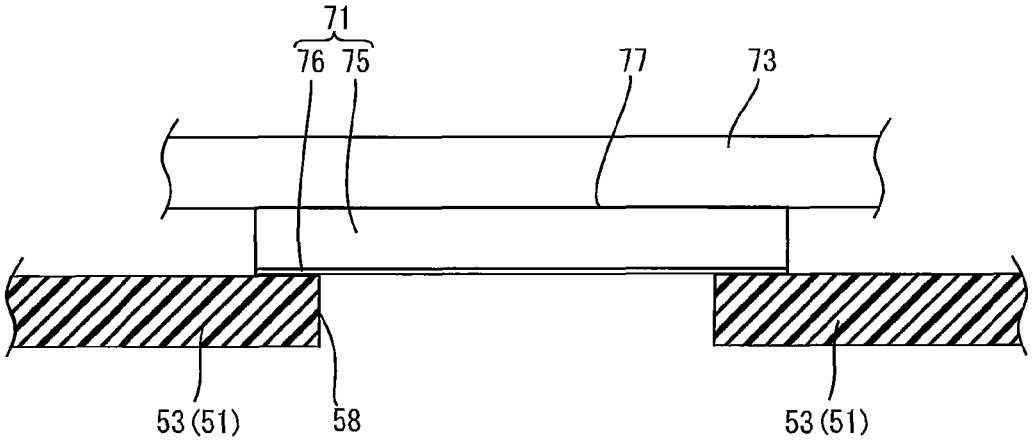
FIG. 27B is a cross-sectional view taken along a line XXVIIB-XXVIIB in FIG. 27A.

The toner seal 71 may be bonded to the shutter 73, rather than to the main body 51, as illustrated in FIGS. 27A and 27B. That is, the fixing surface 77 of the elastic layer 75 is attached to the shutter 73 with adhesive at such a position that the toner seal 71 will be disposed between the shutter 73 and the main body 51 and the toner seal 71 will surround a perimeter of the main-body-side communication through-hole 58 when the shutter 73 is in the closed position. FIG. 27A shows the state where the shutter 73 is in the open position, in which the toner seal 71 is shifted together with the shutter 73 from the main-body-side communication through-hole 58 in the main body 51. FIG. 27B shows the cross-section taken along a line XXVIIB-XXVIIB in FIG. 27A. Also with this configuration, air can readily escape through the mesh layer 76 from the toner box 11. Since the mesh layer 76 of the toner seal 71 slides over the main body 51 when the shutter 73 moves between the open and closed positions, the shutter 73 can be moved with less torque than if the elastic layer 75 was sliding over the main body 51 since the resistance generated by the mesh layer 76 is smaller. In addition, because the shutter 73 is made of a thin film, any toner present in the main-body-side communication through-hole 58 will not rest on the edge of the shutter 73 when the shutter 73 moves from the open position to the closed position. So, toner will not drop off the shutter 73 after the toner box 11 is removed from the developing unit 7.

(5) Fifth Variation

Figure 28A:
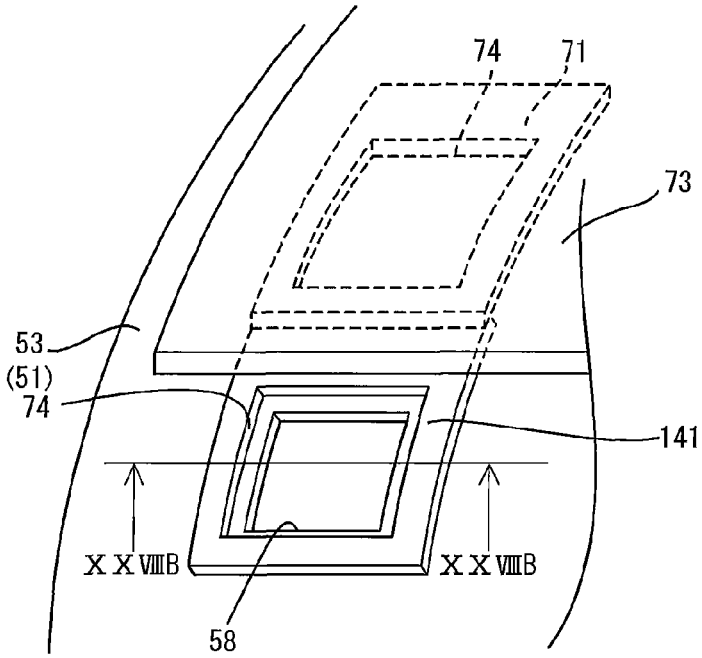
FIG. 28A illustrates how one toner seal is bonded to a main body of the toner box and another toner seal is bonded to the shutter, according to another variation.
Figure 28B:
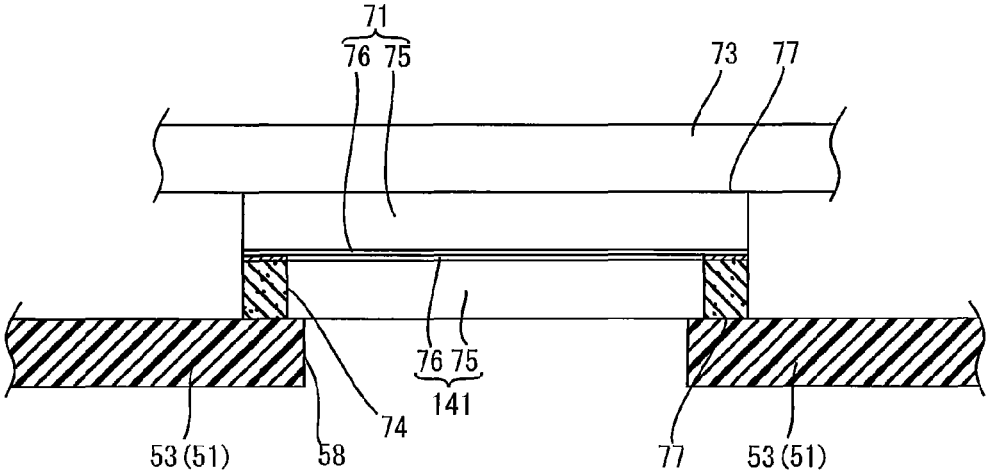
FIG. 28B is a cross-sectional view taken along a line XXVIIIB-XXVIIIB in FIG. 28A.

As shown in FIGS. 28A and 28B, separate toner seals 141 having the same structure as the toner seals 71 shown in FIGS. 27A and 27B may be bonded to the arcing surface 53 of the main body 51 in such positions that the toner seals 71 will oppose and contact the corresponding toner seals 141 when the shutter 73 is in the closed position. That is, the fixing surface 77 of the elastic layer 75 in the toner seal 71 is attached to the shutter 73 with adhesive and the fixing surface 77 of the elastic layer 75 in the toner seal 141 is attached to the main body 51 at such positions that the toner seal 71 and the toner seal 141 will be disposed between the shutter 73 and the main body 51 and the toner seals 71 and 141 will surround a perimeter of the main-body-side communication through-hole 58 when the shutter 73 is in the closed position. FIG. 28A shows the state where the shutter 73 is in the open position, in which the toner seal 71 is shifted together with the shutter 73 from the toner seal 141 that is attached on the main body 51. FIG. 28B shows the cross-section taken along a line XXVIIIB-XXVIIIB in FIG. 28A. Also with this configuration, air can readily escape through the layers 76 in the toner seals 71 and 141 from the toner box 11. Because the shutter 73 is made of a thin film, any toner present in the main-body-side communication through-hole 58 will not rest on the edge of the shutter 73 when the shutter 73 moves from the open position to the closed position. So, toner will not drop off the shutter 73 after the toner box 11 is removed from the developing unit 7.

(6) Sixth Variation

In the structure of the embodiment shown in FIG. 16A, the rear edge of the shutter 73 is positioned farther forward than the front edges of the cover-side communication through-holes 83 when the shutter 73 is in the open position. However, the rear edge of the shutter 73 may be positioned farther to the rear than the front edges of the cover-side communication through-holes 83, provided that the main-body-side communication through-holes 58 formed in the main body 51 (and preferably the main-body-side communication through-holes 58 and the openings 74 formed in the toner seals 71) are entirely open. In other words, it is sufficient that the rear edge of the shutter 73 is positioned farther forward than the front edges of the main-body-side communication through-holes 58 when the shutter 73 is in the open position.

(7) Seventh Variation

Figure 29:
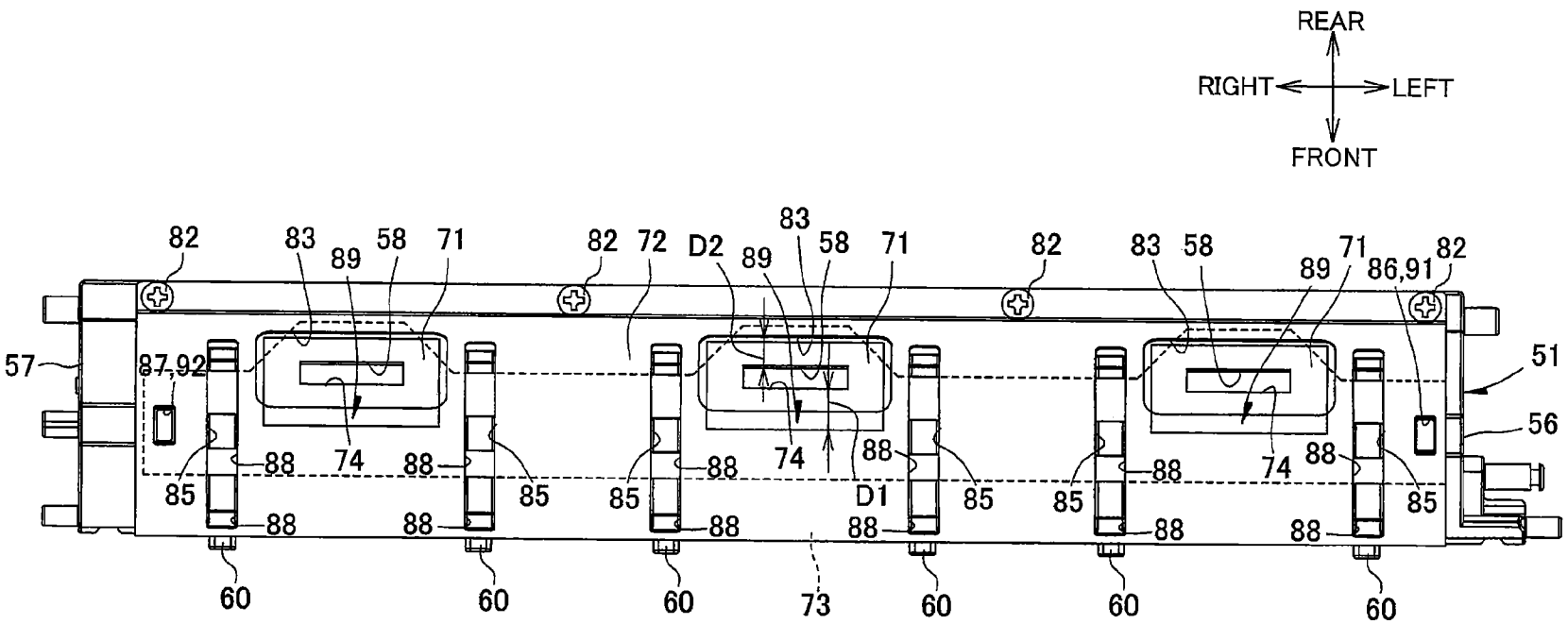
FIG. 29 is a bottom view of a toner box according to a variation of the embodiment that employs a shutter of a different shape.

In the embodiment, when the shutter 73 is in the closed position, the shutter 73 contacts the shutter cover 72 around the entire peripheries of the cover-side communication through-holes 83, as shown in FIG. 16B. However, the shutter 73 may be formed in the shape shown in FIG. 29 so that the shutter 73 does not contact the shutter cover 72 around the entire peripheries of the cover-side communication through-holes 83, that is, so that the shutter 73 does not contact the shutter cover 72 on some part of the peripheries of the cover-side communication through-holes 83.

While the invention has been described in detail with reference to the embodiment and variations thereof, it would be apparent to those skilled in the art that various changes and modifications may be made therein without departing from the spirit of the invention.

In the above-described embodiment, the toner box 11 is detachably mounted on the developing unit 7. However, the toner box 11 may be detachably mounted in the image-forming device 1 at a position different from the developing unit 7. A toner transferring unit, such as an auger, may be provided in the image-forming device 1 to transfer toner from the toner box 11 to the developing unit 7.

What is claimed is:

1. A toner box comprising:

a main body that is configured to accommodate toner therein and that has a main-body-side communication through-hole, through which an interior and an exterior of the main body communicate;

a shutter configured to move between an open position in which the shutter opens the main-body-side communication through-hole, and a closed position in which the shutter closes the main-body-side communication through-hole; and a shutter cover that is configured to cover the shutter and that is elastically deformable, wherein the shutter cover comprises an inner side surface and an outer side surface that is separated from the inner side surface by a fixed amount of distance, wherein the shutter is configured to move between the open position and the closed position while sliding against the inner side surface of the shutter cover, and wherein the outer side surface of the shutter cover is exposed to an outside of the toner box.

2. A toner box according to claim 1, further comprising a toner seal that is configured to be disposed between the main body and the shutter and surround a perimeter of the main-body-side communication through-hole when the shutter is in the closed position.

3. A toner box according to claim 1, wherein the shutter cover is formed of a film.

4. A toner box according to claim 3, wherein a thickness of the shutter cover is greater than or equal to 0.03 mm and smaller than or equal to 0.3 mm.

5. A toner box according to claim 4, wherein the thickness of the shutter cover is greater than or equal to 0.08 mm and smaller than or equal to 0.2 mm.

6. A toner box according to claim 1, wherein the shutter has a shutter drive opening formed therein, a shutter drive protrusion provided in a developing unit in an image forming device being engaged in the shutter drive opening.

7. A toner box according to claim 6, wherein a pair of shutter drive openings are formed in the shutter such that one shutter drive opening is disposed on each side of the main-body-side communication through-hole with respect to a direction orthogonal to a moving direction, in which the shutter moves.

8. A toner box according to claim 6, wherein a guide slit is formed in the shutter cover at a position corresponding to the shutter drive opening and extending along a moving direction, in which the shutter moves.

9. A toner box according to claim 6, wherein an escape groove is formed in the main body at a position corresponding to the position of the shutter drive opening and extending in a moving direction, in which the shutter moves.

10. A toner box according to claim 1, wherein the main body has a plurality of the main-body-side communication through-holes.

11. A toner box according to claim 1, wherein the shutter cover is formed with a cover-side communication through-hole at a position corresponding to the main-body-side communication through-hole to allow communication of toner through the main-body-side communication through-hole.

12. A toner box according to claim 11, wherein an area of the cover-side communication through-hole is greater than an area of the main-body-side communication through-hole.

13. A toner box according to claim 11, wherein a slanted part is formed on the shutter cover as part of a peripheral edge of the cover-side communication through-hole, the slanted part slanting at an angle to a moving direction, in which the shutter moves, thereby causing a dimension of the cover-side communication through-hole in a direction orthogonal to the moving direction of the shutter to grow narrower toward a downstream side with respect to a closing direction, in which the shutter is moved from the open position to the closed position.

14. A toner box according to claim 1, wherein the shutter cover is thinner than the shutter.

15. A toner box according to claim 1, wherein the main body is formed with a positioning protrusion protruding toward the shutter cover; and the shutter cover is formed with a positioning opening, in which the positioning protrusion is engaged.

16. A toner box according to claim 1, wherein a slanted part slanted at an angle to a moving direction, in which the shutter moves, is formed on a leading edge of the shutter in a closing direction, in which the shutter moves from the open position to the closed position.

17. A toner box according to claim 1, wherein a locking protrusion protruding toward the shutter is provided on the main body; and a locking opening is formed in the shutter, the locking protrusion being configured so as to be capable of being engaged in the locking opening when the shutter is in the closed position.

18. A developing device comprising:

a developing unit that is configured so as to be capable of being disposed in a device body of an image-forming device; and a toner box that is detachably mounted in the developing unit, the toner box comprising:

a main body that is configured to accommodate toner therein and that has a main-body-side communication through-hole, through which an interior and an exterior of the main body communicate;

a shutter configured to move between an open position in which the shutter opens the main-body-side communication through-hole, and a closed position in which the shutter closes the main-body-side communication through-hole; and a shutter cover that is configured to cover the shutter and that is elastically deformable;

the developing unit being provided with a shutter drive member that is configured to move the shutter of the toner box between the open position and the closed position, wherein the shutter cover comprises an inner side surface and an outer side surface separated from the inner side surface by a fixed amount of distance, wherein the shutter is configured to move between the open position and the closed position while sliding against the inner side surface of the shutter cover, and wherein the outer side surface of the shutter cover is exposed to an outside of the toner box.

19. A developing device according to claim 18, wherein the shutter drive member is formed in a plate shape configured by laminating a metal plate and a resin plate one on the other.

20. A developing device according to claim 19, wherein the resin plate is formed with a shutter drive protrusion; and the shutter is formed with a shutter drive opening, the shutter drive protrusion being configured so as to be capable of being engaged in the shutter drive opening.

21. A developing device according to claim 20, wherein the metal plate is formed with an insertion through-hole, through which the shutter drive protrusion is inserted.

22. A developing device according to claim 19, wherein the resin plate is formed with a gear that is configured to receive an inputted drive force for moving the shutter.

* * * * *